US005836404A

United States Patent [19]

Trujillo et al.

[11] Patent Number: 5,836,404

[45] Date of Patent: Nov. 17, 1998

[54] DRILL BITS WITH ENHANCED HYDRAULIC FLOW CHARACTERISTICS

[75] Inventors: William R. Trujillo, South Salt Lake, Utah; Sean K. Berzas, The Woodlands, Tex.; Craig H. Cooley, Bountiful; Wayne R. Hansen, Centerville, both of Utah

[73] Assignee: Baker Hughes Incorporated, Houston, Tex.

[21] Appl. No.: 927,058

[22] Filed: Sep. 10, 1997

Related U.S. Application Data

[62] Division of Ser. No. 631,448, Apr. 12, 1996.

[51] Int. Cl.[6] ..... E21B 7/00; E21B 10/60

[52] U.S. Cl. ..... 175/57; 175/339

[58] Field of Search ..... 175/57, 65, 321, 175/329, 339, 340, 343, 393

[56] References Cited

U.S. PATENT DOCUMENTS

| | | |
|---|---|---|
| 3,693,735 | 9/1972 | Cortes . |
| 4,190,125 | 2/1980 | Emmerich et al. . |
| 4,200,160 | 4/1980 | Necomb . |
| 4,245,708 | 1/1981 | Cholet et al. . |
| 4,331,207 | 5/1982 | Castel . |
| 4,351,402 | 9/1982 | Gonzalez . |
| 4,368,787 | 1/1983 | Messenger . |
| 4,390,072 | 6/1983 | Phelan . |
| 4,463,220 | 7/1984 | Gonzalez . |

(List continued on next page.)

FOREIGN PATENT DOCUMENTS

| | | |
|---|---|---|
| 0 225 082 | 6/1987 | European Pat. Off. . |
| 0 171 915 | 5/1989 | European Pat. Off. . |
| 2 719 626 | 11/1995 | France . |
| 2300657 | 4/1996 | United Kingdom . |
| WO 84/01186 | 3/1984 | WIPO . |

OTHER PUBLICATIONS

Search Report, dated Jun. 23, 1997, 1 page.

Cunningham, *Liquid Jet Pump Modleing: Effects of Axial Dimensions on Theory–Experiment Agreement*, 2nd Symposium on Jet Pumps & Ejectors and Gas Lift Techniques (Mar. 24–26, 1975) at F1–1 through F1–15.

Huffstutler, *Flow Pattern Changes Improve Roller Cone Bit Performance*Oil & Gas Journal (May 6, 1996) at 113–116.

Schmitt, *Diversity of Jet Pumps and Ejector Techniques*, 2nd Symposium on Jet Pumps & Ejectros and Gas Lift Techniques (Mar. 24–26, 1975) at A4–35 through A4–A9.

*Primary Examiner*—Frank Tsay
*Attorney, Agent, or Firm*—Trask, Britt & Rossa

[57] ABSTRACT

This invention discloses a drilling structure having a body defining at least one primary channel and at least one secondary channel therein to initiate and maintain recirculation of an amount of drilling fluid back through the secondary channel to maintain positive, independent flow of drilling fluid through each primary channel of the drilling structure. The recirculation of drilling fluid is encouraged by providing a recirculation passageway in fluid communication with the primary channel defined by a portion of the body of the drilling structure that separates positively flowing drilling mud from drilling mud that is being recirculated. The recirculation action of the fluid in the recirculating loop may be fed and brought about by entrainment of the fluid with jetted fluid from an adjacent nozzle. The portion of the body may form a partition, such as a wall extending at least partially between the sides of the primary channel, a fin positioned within the primary channel that generally radially extends from the centerline of the drilling structure, or an internal channel or feeder that extracts fluid from the annulus at a point of low velocity and reintroduces it at a point of higher velocity proximate the bit face, usually near a nozzle. In addition, portions of the drilling structure are streamlined to further encourage positive, stable flow of fluid and formation cuttings generated from an associated cutting structure.

12 Claims, 21 Drawing Sheets

U.S. PATENT DOCUMENTS 4,492,277 1/1985 Creighton .
4,540,055 9/1985 Drummond et al. .
4,577,706 3/1986 Barr .
4,673,045 6/1987 McCullough .
4,727,946 3/1988 Barr et al. .
4,733,734 3/1988 Bardin et al. .
4,733,735 3/1988 Barr et al. .
4,738,320 4/1988 Bardin et al. .
4,744,426 5/1988 Reed .
4,794,944 1/1989 Deane et al. .
4,819,746 4/1989 Brown et al. .
4,848,491 7/1989 Burridge et al. .
4,856,601 8/1989 Raney .
4,869,330 9/1989 Tibbitts .
4,883,132 11/1989 Tibbitts .
4,887,677 12/1989 Warren et al. .
4,913,244 4/1990 Trujillo .
5,096,005 3/1992 Ivie et al. .
5,099,932 3/1992 Hixon .
5,143,162 9/1992 Lyon et al. .
5,199,511 4/1993 Tibbitts et al. .
5,284,215 2/1994 Tibbitts .
5,293,946 3/1994 Besson et al. .
5,355,967 10/1994 Mueller et al. .
5,363,932 11/1994 Azar .
5,417,296 5/1995 Murdock .
5,433,280 7/1995 Smith .
5,671,818 9/1997 Newton et al. .

DRILL BITS WITH ENHANCED HYDRAULIC FLOW CHARACTERISTICS

This is a division of application Ser. No. 08/631,448, filed Apr. 12, 1996, pending.

BACKGROUND OF THE INVENTION

1. Field of the Invention

This invention relates generally to drill bits and other drilling-related structures used for drilling subterranean formations and, more specifically, to drilling structures of the type having one or more recirculation channels that are configured to initiate and maintain partial drilling fluid recirculation within a flow loop on the exterior of the drilling structure, between an interior channel and an interior channel of the drilling structure, or a combination thereof. Positive, independent flow of drilling fluid through each of a drilling structure's recirculation loops is maintained, and hydraulic efficiency enhanced for more effective cooling and clearing and formation cuttings removal from the cutting structure. The invention additionally relates to streamlining of exterior topographic features on drill bits and other drilling-related structures to reduce flow stagnation and to promote cuttings removal and passage of other debris.

2. State of the Art

The equipment used in subterranean drilling operations is well known in the art and generally comprises a drill bit attached to a drill string, including drill pipe and drill collars. A rotary table or other device such as a top drive is used to rotate the drill string from a drilling rig, resulting in a corresponding rotation of the drill bit at the free end of the string. Fluid-driven downhole motors are also commonly employed, generally in combination with a rotatable drill string, but in some instances as the sole source of rotation for the bit. The drill string typically has an internal bore extending from and in fluid communication between the drilling rig at the surface and the exterior of the drill bit. The string has an outer diameter smaller than the diameter of the well bore being drilled, defining an annulus between the drill string and the wall of the well bore for return of drilling fluid and entrained formation cuttings to the surface.

A typical rotary drill bit includes a bit body secured to a steel shank having a threaded pin connection for attaching the bit body to the drill string, and a body or crown comprising that part of the bit fitted on its exterior with cutting structures for cutting into an earth formation. Generally, if the bit is a fixed-cutter or so-called "drag" bit, the cutting structure includes a plurality of cutting elements including cutting surfaces formed of a superabrasive material such as polycrystalline diamond and oriented on the bit face generally in the direction of bit rotation. A drag bit body is generally formed of machined steel or a matrix casting of hard, particulate material such as tungsten carbide in a (usually) copper-based alloy binder.

In the case of steel body bits, the bit body is usually machined, typically using a computer-controlled, five-axis machine tool, from round stock to the desired shape, including internal watercourses and passages for delivery of drilling fluid to the bit face, as well as cutting element sockets and ridges, lands, nozzle displacements, junk slots and other external topographic features. Hardfacing is applied to the bit face and to other critical areas of the bit exterior, and cutting elements are secured to the bit face, generally by inserting the proximal ends of studs on which the cutting elements are mounted into apertures (sockets) bored into the bit face. The end of the bit body opposite the face is then threaded, made up and welded to the bit shank.

The body of a matrix-type drag bit is cast in a mold interiorly configured to define many of the topographic features on the bit exterior, with additional preforms placed in the mold defining the remainder as well as internal features such as watercourses and passages. Tungsten carbide powder and sometimes other metals to enhance toughness and impact resistance are placed in the mold under a liquefiable binder in pellet form. The mold assembly, including a steel bit blank having one end inserted into the tungsten carbide powder, is placed in a furnace to liquify the binder and form the body matrix with the steel bit blank integrally secured to the body. The blank is subsequently affixed to the bit shank by welding. Superabrasive cutting elements may be secured to the bit face during the furnacing operation if the elements are of the so-called "thermally stable" type, or may be brazed by their supporting (usually cemented WC) substrates to the bit face, or to WC preforms furnaced into the bit face during infiltration.

During a drilling operation using such a rotary bit, drilling fluid is typically pumped from the surface through the internal bore of the drill string to the bit (except in a reverse flow drilling configuration such as is described in U.S. Pat. No. 4,368,787, wherein drilling fluid passes down the annulus and up the interior of the drill string). In conventional bits, the drilling fluid flows out of the drill bit through a crow's foot or one or more nozzles placed at or near the bit face for the purpose of removing formation cuttings (i.e., chips of rock and of other formation material removed from the formation by the cutting elements of the drill bit) and to cool the cutting elements, which are frictionally heated during cutting. Both of these functions are extremely important for the drill bit to efficiently cut the formation over a commercially-viable drilling interval. That is, because of the weight on bit (WOB) applied by the drill string necessary to achieve a desired rate of penetration (ROP) and the frictional heat generated on the cutters due to WOB and rotation of the bit, without drilling fluid or some other means of cooling the bit, materials comprising the drill bit and particularly the cutting elements attached to the bit face would structurally degrade and prematurely fail. Moreover, even if it were possible to cool the bit without drilling fluid but no means of removing the cuttings from the bit face was employed, the cutting elements (and the bit) would simply become balled up with material cut from the formation and would not be able to effectively engage and further penetrate into the formation to advance the well bore.

The need to efficiently remove cuttings from the bit during drilling has long been recognized in the art. Junk slots formed on the exterior of the bit body adjacent the gage of the bit provide channels for drilling fluid to flow from the face of the drill bit past the gage and to the annulus above, between the drill string and the well bore. The pressure of the drilling fluid as delivered to the cutting elements through the nozzles or other ports or openings must be sufficient to overcome the hydrostatic head at the drill bit, and flow velocity sufficient to carry the drilling fluid with entrained cuttings through the annulus to the surface.

In a typical bladed rotary drill bit, there may be a plurality of nozzles, each associated with one or more blades, the nozzles directing drilling fluid across cutting elements of the blades. There may also be a plurality of junk slots, positioned between the blades and extending along the gage of the bit, to promote the flow of drilling fluid along each blade through its respective, associated junk slot. However, because the position and angular orientation of each nozzle is usually different relative to the centerline of the bit, and nozzle flow volumes may vary due to the hydraulics of the internal bit passages delivering the drilling fluid to the nozzles, the magnitude and orientation of flow energy of the drilling fluid will vary from one junk slot to the next. Consequently, because a relatively higher flow energy generates an adjacent zone or area of relatively lower hydraulic pressure in the manner of a venturi, drilling fluid emanating from a particular nozzle that would ideally flow past the desired cutting elements of a particular blade and up through the associated junk slot may actually be pulled or drawn downward and even laterally (circumferentially) across the exterior of the blade into a low pressure zone created by a fluid jet of another junk slot. In effect, some junk slots will have a positive or upward flow of drilling mud, while others will have a negative or downward flow resulting from thiefage of a part of the fluid flow by an adjacent junk slot flow zone and destruction of the desired, beneficial flow pattern in the junk slot from which the fluid is stolen. In addition, typical prior art bit designs include stagnant flow regions in and above the junk slots, usually adjacent, behind and above the blades where no appreciable drilling fluid flow, either positive or negative, occurs. These stalled or stagnant flow areas or "dead zones" may be the result of unexpected and undesired vortices that may enhance or even initiate negative flow in some junk slots, or may be the result of bad design which fails to recognize the effect of bit topography on flow of adjacent fluid. If such a disrupted flow pattern occurs, cuttings generated during the drilling process that would normally flow up through the annulus may circulate from a positive flowing junk slot to a negative flowing junk slot, or may accrete in place adjacent or above a blade, the result in either case, particularly at low flow rates, being bit balling as the cuttings mass increases. In other words, these recycling or stationary cuttings impede cutting efficiency of the cutters by obstructing access by the cutting elements to the formation. In addition, stagnant or reduced flow of drilling fluid results in less effective cooling of the cutting elements in those areas where the flow is impaired.

One arrangement to promote clearing of cuttings from a bit has been to position nozzles in the face of the drill bit across the face of the cutting elements to essentially peel cuttings from the cutting elements, as disclosed in U.S. Pat. No. 4,913,244 to Trujillo. U.S. Pat. No. 4,794,994 to Deane et al. discloses impacting the cutting elements with rearwardly-directed fluid flow bounced off of the formation ahead of the cutting elements. Another solution, to remove cuttings from the cutting elements immediately after shearing from the formation by impacting them with a forwardly-directed fluid jet from behind the cutting elements, is disclosed in U.S. Pat. No. 4,883,132 to Tibbitts. Another arrangement for directing fluid flow on the bit face, that of restricting fluid flow on the bit face and directing same through the use of spirally-placed dams, is disclosed in U.S. Pat. No. 4,492,277 to Creighton. Yet another approach, to sweep the formation directly with fluid emanating from nozzles on the bit, is disclosed in European Patent Application 0 225 082 to Fuller et al.

In an attempt to more efficiently cut into the formation, variously-configured fluid courses have been devised, including those of U.S. Pat. No. 4,887,677 to Warren et al., which discloses a progressively widening diffuser that allows fluid to be flowed through a narrow throat of a fluid course in front of the cutting element and out a progressively widening diffuser, purportedly resulting in a significantly reduced pressure in front of the cutting elements. U.S. Pat. No. 5,245,708 to Cholet et al. discloses a junk slot having an upwardly-directed nozzle placed in a venturi configuration to enhance the flow of drilling fluid through the junk slot. A similar arrangement is disclosed in U.S. Pat. No. 4,540,055 to Drummond et al. in the form of an air-drilling assembly, wherein upwardly-aimed nozzles are placed on a sub above a rock bit between and parallel to vanes on the exterior of the sub.

It has also been recognized in the art that creating a flow vortex proximate the cutting elements may be desirable. For example, U.S. Pat. No. 4,733,735 to Barr et al. discloses a rotary drill bit having an exterior surface region adjacent the front surface of each blade and shaped to promote a vortex flow of drilling fluid across the cutting elements of that blade and partial recirculation of the drilling fluid before passage of same from the bit and up the annulus. Similarly, in U.S. Pat. No. 4,848,491 to Burridge et al., it is acknowledged that a bit may be configured to form a vortex to recirculate a portion of the drilling fluid directed into a junk slot by a nozzle.

One of the more elaborate methods and apparatus for removing drilling mud disclosed in U.S. Pat. No. 4,744,426 to Reed includes a downhole motor and "fan" that pulls the drilling mud from around the drill bit. Such a device, however, is a complex mechanical structure and adds to the cost of the drill string.

U.S. Pat. No. 5,199,511 to Tibbitts discloses a unique bit configuration wherein the flow path from the bit interior to an area above the gage is located within the bit crown, the cuttings entering an interior flow area after being cut, then being swept upwardly by the drilling fluid.

U.S. Pat. No. 5,284,215 to Tibbitts discloses an enlarged and undercut junk slot for enhancing fluid flow, which structure extends upwardly into the bit shank area above the crown.

None of the aforementioned references, however, provides a structure and flow path directing and enhancing positive, independent flow of drilling fluid and entrained cuttings through all of the junk slots of a drill bit, substantially eliminating cross-flow and thiefage between junk slots and minimizing stagnant or dead flow zones in areas within and above the junk slots, which zones promote cuttings accretion and bit balling. Thus, it would be advantageous to provide a drill bit and other drilling-related structures with enhanced hydraulic characteristics affording such advantages.

SUMMARY OF THE INVENTION

Accordingly, in a preferred embodiment, a rotary-type drill bit for drilling subterranean formations is disclosed and is generally comprised of a bit body including a cutting structure at one end and a drill string connector as known in the art at the other. The drill bit includes an internal plenum or other passageways to supply the exterior of the drill bit with drilling fluid from the drill string. Various internal fluid passages though the bit body or crown feed nozzles near the cutting structure that direct the drilling fluid in the form of jets toward the cutting structures to cool the cutting structures and remove formation cuttings and other debris from the bottom of the well bore.

Located between the cutting structure and the drill string connector is at least one fluid course extending into a primary circulation channel located proximate and above the cutting structure to carry fluid flow to a position proximate the annulus above the bit created between the drill string and the wall of the well bore being drilled. The cutting structure may include a plurality of blades with fixed cutting elements attached thereto, a plurality of roller cones, or a crown structure designed for coring. In general, this invention relates to the configuration of exterior and interior fluid courses and channels for circulation and recirculation of drilling fluid in any such bit, other subterranean bit designs known in the art, or other drilling-related structures such as near-bit stabilizers and reamer wings.

The gage of a bit typically defines a substantially cylindrical area above the cutting structure with a diameter substantially equal to (slightly smaller than) the diameter of the hole being drilled. Junk slots provide a channel adjacent and through the gage area of the drill bit in order for drilling fluid to flow from the vicinity of the cutting structure past the gage of the bit. In a bit having a reduced-sized gage or no gage, that is, a bit having a portion immediately above the cutting structure that is smaller than the diameter of the hole being drilled, junk slots may equally provide a channel to allow passage of drilling mud from the cutting structure to the annulus between the drill string and the well bore. The primary flow channels of this invention provide a structure to effect this positive flow of drilling mud from the cutting elements to the annulus. More specifically, positive flow of drilling mud through a primary flow channel of the present invention is in fluid communication with a recirculation channel, such that a portion of the positively flowing drilling fluid is recirculated back toward the cutting structure to create a flow loop. In essence, the primary and secondary flow channels of the invention define composite junk slots providing a recirculation loop.

In a preferred embodiment, each junk slot includes a longitudinally-extending, secondary recirculation passageway or channel separated by a partition from a primary passageway or channel. The partition separates the flow of drilling fluid such that drilling fluid flowing toward the drill stem (positive flow) is effectively isolated from the recirculating flow. The partition may be in the form of a circumferentially-extending wall extending at least partially between the sidewalls of the junk slot from one blade toward another (if a blade-type bit), a fin that extends radially from the bottom of the junk slot away from the longitudinal axis of the drill bit, or a combination of the two such that the partition extends from one sidewall to the bottom of the junk slot or the partition includes one or more longitudinally extending vanes. The partition may be configured and positioned any distance from the longitudinal axis of the bit so long as two channels are formed, one for positive flow and one for recirculating flow, of a cross-sectional area sufficient to pass formation cuttings and other debris likely to be encountered in the wellbore. It is preferred, however, that the primary channel be of greater cross-sectional area than the secondary, recirculation channel.

In general, the partition has substantially streamlined outer surfaces. Moreover, whether the partition is a wall-like member or a fin , the same longitudinal cross-sectional configurations may provide the desired streamlined outer surface. In one preferred embodiment, the partition has a cigar-shaped cross-section. In another preferred embodiment, the partition has an airfoil cross-section. In yet another embodiment, the partition has a banana-shaped cross-section. In another preferred embodiment, the partition has an angled entry portion to help direct the flow of drilling fluid coming off the cutters into the upwardly-flowing fluid into the primary channel. In still another embodiment, the partition includes a deflector portion to direct debris in the drilling fluid away from the recirculation channel.

In yet another embodiment, the top edge of the partition includes a stepped portion such that the step descends toward the recirculation channel. Such a step promotes the development of a vortex at the step to encourage a portion of the positively flowing drilling fluid into the recirculation channel. The top edge of the partition may also include a series of steps to promote a group of vortices.

In a preferred embodiment utilizing a fin as the partition, the fin may have an outwardly-tapered cross-section or an inwardly-tapered cross-section.

In yet another preferred embodiment, a rotary-type drill bit is provided with a recirculation channel comprising at least one internal bore extending between a location proximate the cutting structure in at least one of the junk slots of the bit and a location proximate the top of the gage portion. In a more particular aspect of the embodiment, a plurality of such recirculation channels is provided, at least one of which is provided for each junk slot of the bit. An internal annular chamber is provided in the bit into which all of the recirculation channels are in fluid communication. One or more channels are connected to the annular chamber to provide a fluid passage to proximate the top of the gage portion. With such a configuration, the pressure of recirculation flow can be equalized between all recirculation channels.

In another preferred embodiment of the present invention, a tri-cone roller bit is provided having at least one recirculation channel associated with at least one junk slot of the bit.

In yet another preferred embodiment, a near-bit stabilizer is provided including the recirculation channel of the present invention. The recirculation channel may be longitudinally extending along the length of the stabilizer, or within one of the blades of the stabilizer. As with other recirculation channels of the present invention, recirculation channels provided in the blades of the stabilizer may reduce flow stagnation by equalizing areas of low pressure with areas of higher pressure.

It is believed that the operating characteristics of the above-described embodiments of the invention simulate or approximate the operation of a venturi or eductor structure. Likened to the former, the present invention accommodates the low-pressure zones adjacent fluid jets emanating from nozzles by providing fluid to backfill these zones from a dedicated source such as a recirculation channel, rather than "stealing" fluid from an adjacent area of the bit face. Approached from another perspective, the invention provides for momentum transfer between the primary flow of fluid in the junk slots and a secondary source of fluid from internal or external recirculation channels, in the manner of an eductor. Given the high pressures and solids-laden nature of drilling fluid in actual operations, it is uncertain which phenomenon, if either, predominates. Suffice it to say that the invention provides enhanced conservation and focus of fluid momentum and thus of entrained particulates through the use of the disclosed recirculation structures.

In another preferred embodiment, the portions of the gage of the bit between and above the junk slots include a streamlined exterior. More specifically, the area above and including the gage portion includes an outwardly tapered edge comprised of one or more planar surfaces or one or more curved surfaces or a combination thereof in a streamlined configuration to eliminate flow-stagnation areas. The back sides of the blades may be similarly reconfigured to reduce or eliminate cutting accretion due to stagnant fluid flow.

Although the drill bit of the present invention has been described in relation to several preferred embodiments, it is believed that major advantages of drilling structures according to the invention are provision of one or more pathways for the recirculation of drilling fluid and reduction in the number of stagnant flow zones, both such features promoting the positive and substantially uniform flow of drilling fluid and cuttings in all of the drilling structure's junk slots and elimination of flow thiefage between junk slots. These and other features of the present invention will become apparent from the following detailed description taken in conjunction with the accompanying drawings, and as defined by the appended claims.

BRIEF DESCRIPTION OF THE DRAWINGS

The features and advantages of the present invention can be more readily understood with reference to the following detailed description of the preferred embodiments, taken in conjunction with the accompanying drawings wherein.

DETAILED DESCRIPTION OF THE ILLUSTRATED EMBODIMENT

Figure 1A:
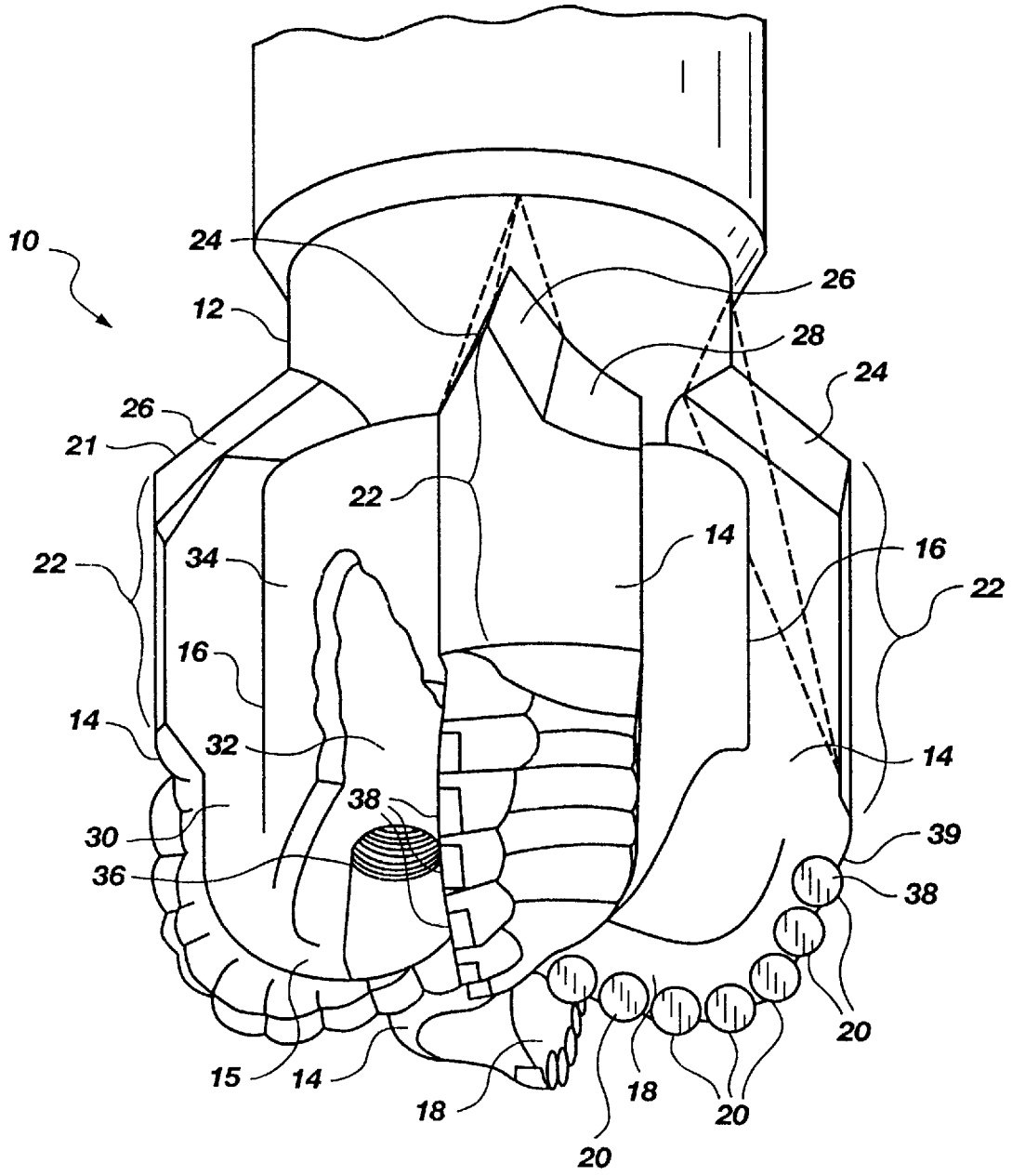
FIG. 1A is a perspective view of a first embodiment of a drilling-related structure in accordance with the present invention.
Figure 1B:
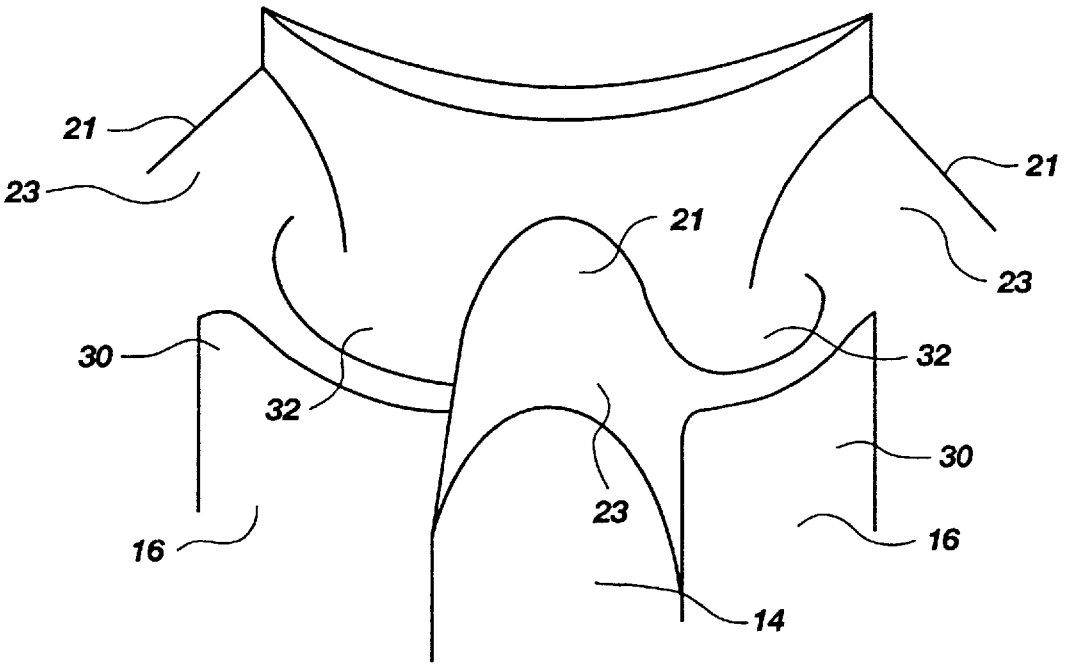
FIG. 1B is a partial perspective view of an alternate embodiment of the top edge of the gage portion of the drilling-related structure shown in FIG. 1A in accordance with the present invention.

A drill bit 10 in accordance with the present invention is illustrated in FIG. 1A . The drill bit 10 is comprised of a bit body 12 including a plurality of longitudinally extending body segments or blades 14 defining junk slots 16 between the blades 14. Each blade 14 defines a leading or cutting face 18 that extends from proximate the center of the bit face around the distal end 15 of the drill bit 10, and includes a plurality of cutting elements 20 oriented to cut into a subterranean formation upon rotation of the drill bit 10. The cutting elements 20 are secured to and supported by the blades 14. Between the uppermost of the cutting elements 20 and the top edge 21 of the blade 14, each blade 14 defines a longitudinally and radially extending gage portion 22 that corresponds to the largest-diameter-portion of the drill bit 10 and thus is only slightly smaller than the diameter of the hole to be drilled by cutting elements 20 of the bit 10. The top edge 21 of each blade 14 is tapered, providing leading (in the direction of bit rotation) streamlined surface 24 and trailing streamlined surfaces 26 and 28. It should also be noted that in a bit where no gage portion 22 is present, such as is disclosed in co-pending U.S. patent application Ser. No. 08/550,092, assigned to the assignee of the present invention, the top edge 21 may extend to proximate the uppermost cutting elements 39 of each blade 14. Broadly, the entire blade may be of tapered or streamlined configuration. Surfaces 24, 26 and 28 help prevent stagnant or dead areas from forming adjacent the blades in the upward flow of drilling fluid from the junk slots 16. As illustrated in FIG. 1B, the top edges 21 of blades 14 may be in the form of one or more curved or arcuate surfaces 23. Such a configuration also prevents vortices from forming around the top edge 21 that may otherwise cause drilling mud from one junk slot 16 to be drawn into another. Of course, a combination of planar and non-planar surfaces, e.g., a combination of the surfaces depicted in FIGS. 1A and 1B, may be employed with blades 14.

Figure 2:
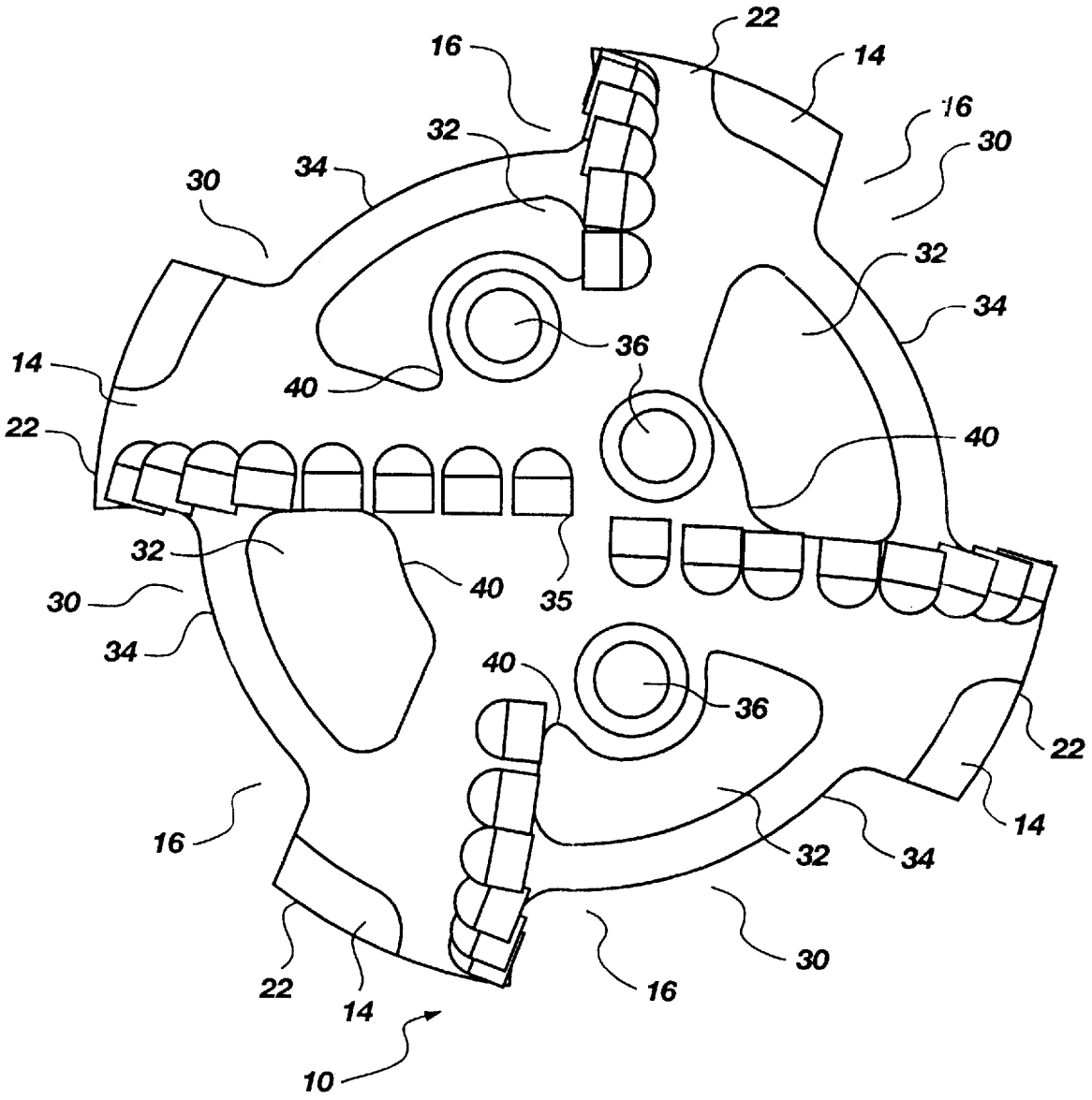
FIG. 2 is a semi-schematic bottom view of the drilling-related structure shown in FIG. 1A.
Figure 3:
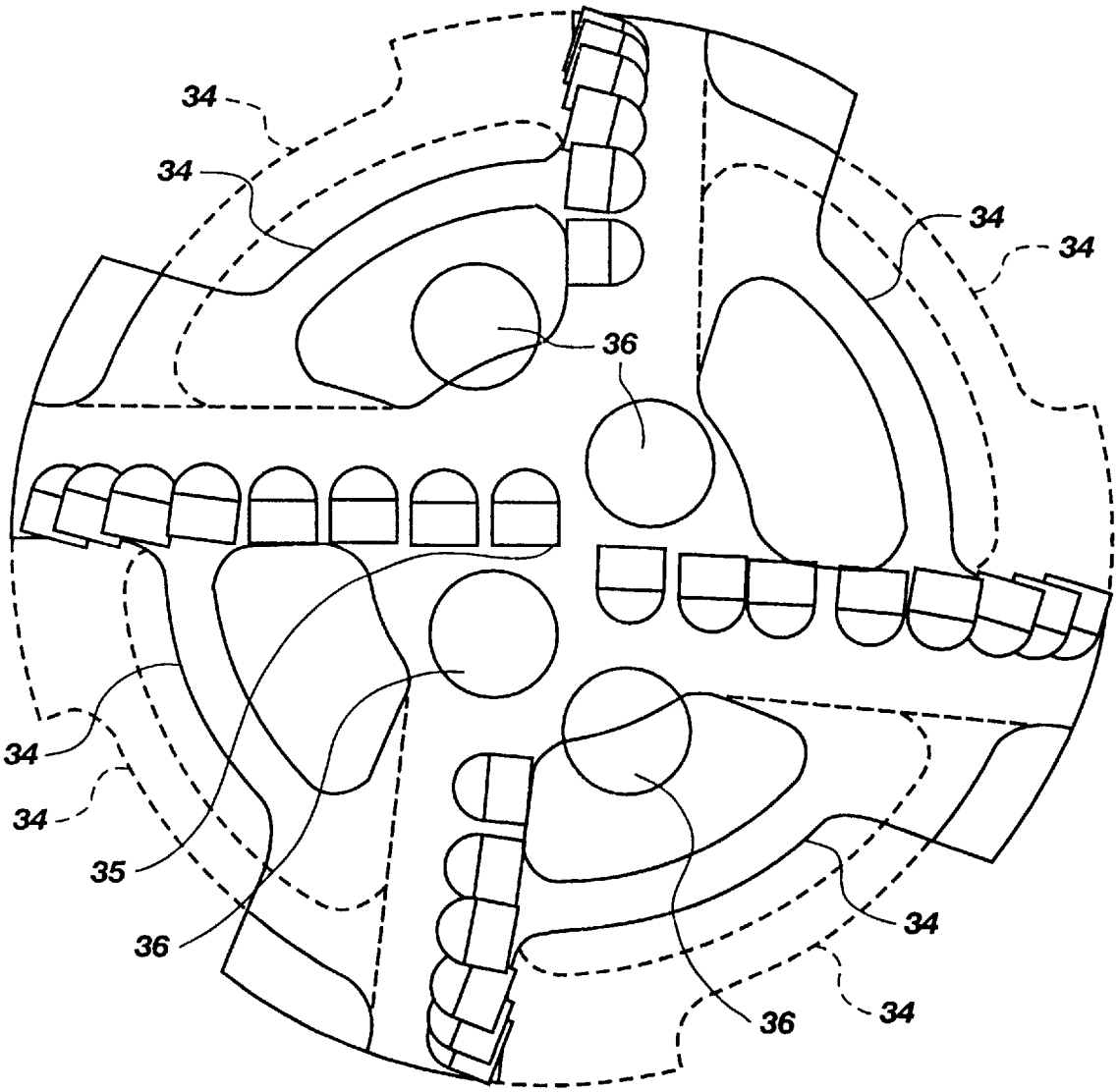
FIG. 3 is a schematic bottom view of the drilling-related structure shown in FIG. 1A illustrating alternative positions of the partition and the corresponding configurations of the junk slots and recirculation passageways in accordance with the present invention, in contrast to the positions and configurations depicted in FIG. 2.

As better illustrated in FIG. 2, between adjacent blades 14, the junk slot of bit 10 is divided into two channels, a primary channel 30 and a secondary recirculation channel 32, by a partition or wall 34 that extends generally circumferentially between the blades 14 and longitudinally extends along a portion of the junk slot 16. The walls 34 as illustrated are each radially positioned substantially the same distance from the center line or longitudinal axis 35 of the drill bit 10, about two-thirds of the distance from the bottom 40 of the junk slot 16 to the gage 22. As illustrated in FIG. 3, however, the walls 34 may be positioned at different distances from the center line 35 of the bit 10, either closer to (solid lines) or further from (broken lines) the center 35 line. In addition, each wall 34 might be positioned at a different radial distance from the center line 35 than an adjacent wall 34. In other words, referring to FIG. 3, some of the walls 34 of a given bit 10 may be located at the solid-line positions, while others may be located at the broken-line positions. A nozzle orifice 36 (see FIGS. 2 and 3) may be positioned adjacent or within a junk slot 16, into which orifice 36 a nozzle (unnumbered) as known in the art may be threaded or otherwise attached. Parts or other apertures in the bit face may also be employed in lieu of nozzles.

Figure 4:
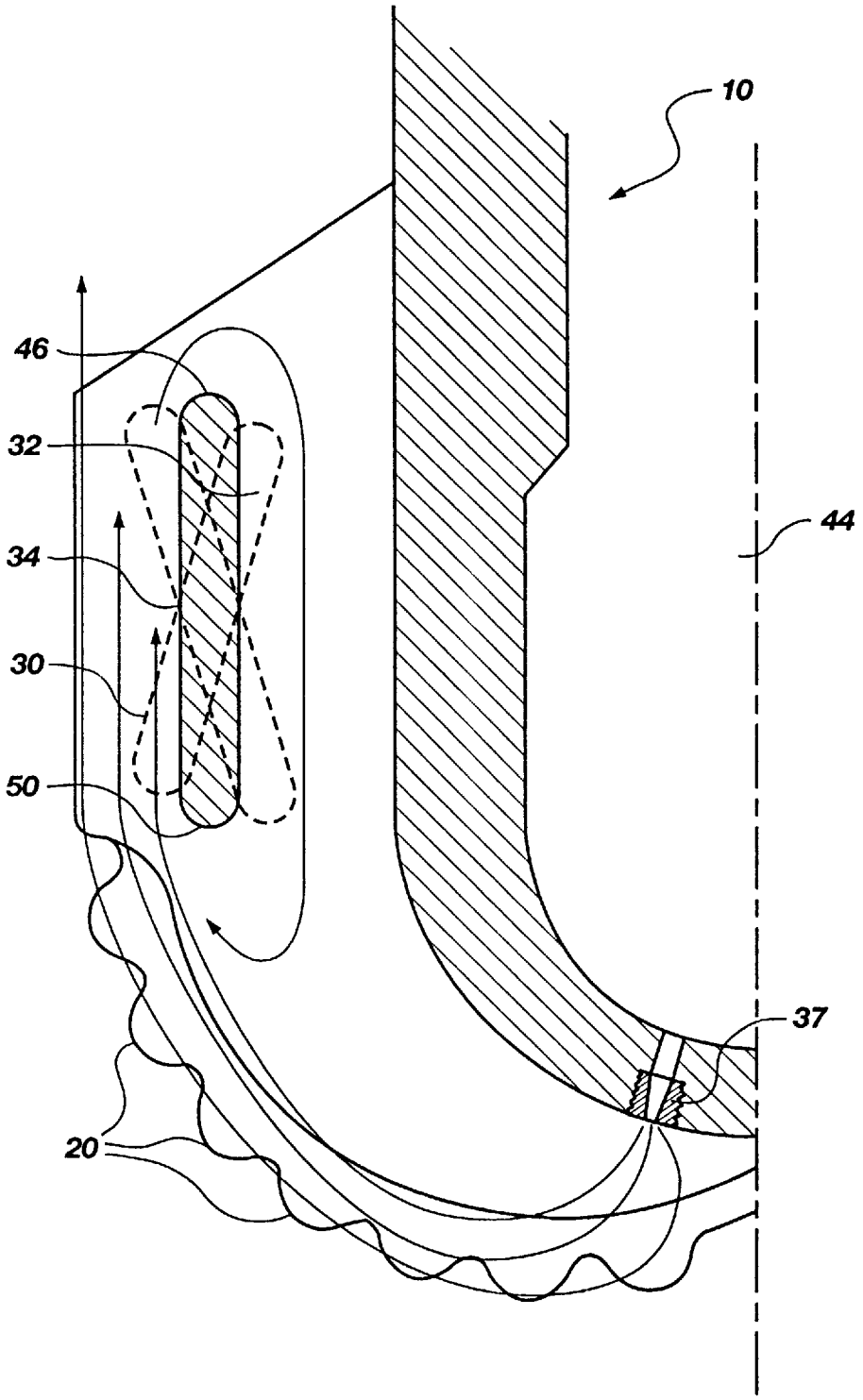
FIG. 4 is a partial cross-sectional view of the drilling-related structure shown in FIG. 1A , illustrating a first embodiment of the longitudinal cross-section of the partition according to the present invention.

Referring now to FIGS. 1A and 4, the flow of drilling fluid, represented by arrows, passing through the nozzle orifice 36 is directed across the faces 38 of the cutting elements 20 where it acts to cool the cutting elements 20 and to remove debris generated by the cutting elements 20 as they cut into the formation. The drilling fluid is supplied from the drill string into the plenum 44 of the drill bit 10. The primary flow of the drilling fluid extends through channel 30 between the wall of the well bore and the wall 34 and thus up through the junk slot 16. As it passes the upper end 46 of the wall 34, however, a portion of the drilling fluid is drawn into the secondary recirculation passageway or channel 32, in effect being pulled from the flow of drilling fluid by a low-pressure area in secondary recirculation channel 32 associated with the primary flow or jet of fluid proximate the lower end 50 of wall 34 from the nozzle 37. As illustrated by broken lines in FIG. 4, the wall 34 may be oriented within the junk slot 16 at an angle other than parallel to the bit axis to advantageously change the flow characteristics of the primary and secondary channels 30 and 32. For example, an inward tilt of the upper end of wall 34 will result in a primary flow channel 30 of steadily increasing cross-section as the channel extends upwardly, simulating the expanding chamber downstream of a throat structure of a venturi. Having such a recirculation channel 32 in each of the junk slots 16, in effect, stabilizes the flow of drilling fluid in each of the junk slots 16, and helps prevent drilling fluid from one junk slot 16 being drawn into another, adjacent junk slot or even one on the other side of the bit.

In the embodiment shown in FIG. 4, the wall 34 has an elongate cross-section with rounded ends 46 and 50. Other cross-sectional configurations, however, may enhance the effectiveness of the secondary recirculation channel 32. For example, in FIG. 5, the wall 52 has a cross-section that forms an airfoil. In FIG. 6, the wall 54 has an angled entry portion 56 and a tapered leading edge 60 to direct and maintain the positive or upward flow of drilling fluid on the front or outer side 58 of the wall 54. In addition, at the top or trailing end 62 of the wall 54, a series of steps 64 are provided. As better seen in FIG. 6A, three steps 66, 68, and 70 descending from the front side 58 of the wall to the back side 72 create vortices in the fluid flow, represented by circling arrows. These vortices draw drilling fluid passing by the front side 58 of the wall 54 to the back side 72 and enhance recirculation. Although three steps 66, 68, and 70 are illustrated, one or more such steps (or other vortex-inducing arrangements, such as scallops, ridges, etc.) of various sizes may be employed to enhance recirculation.

Figure 7A:
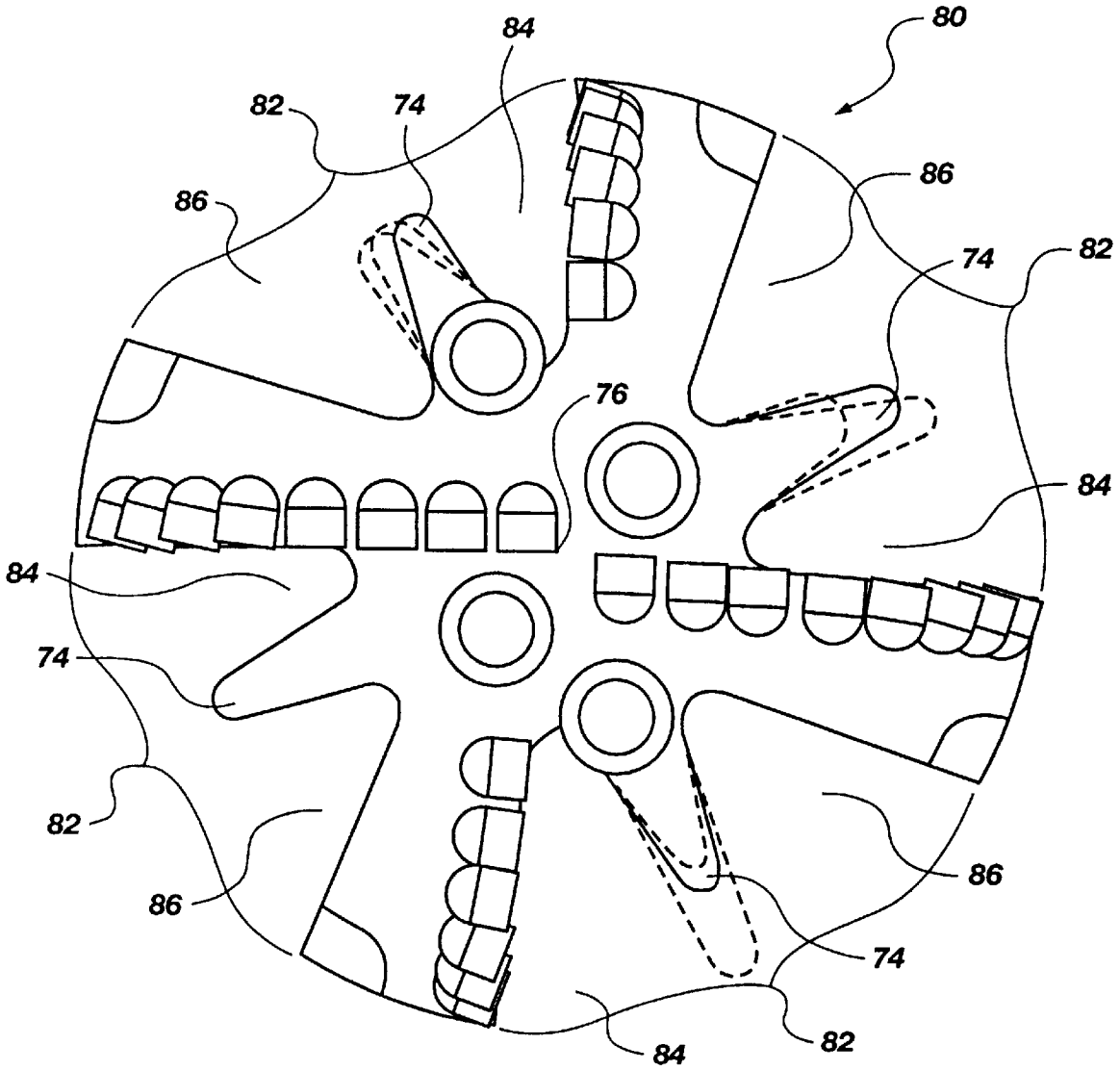
FIG. 7A is a schematic bottom view of a second embodiment of the drilling-related structure in accordance with the present invention.
Figure 7B:
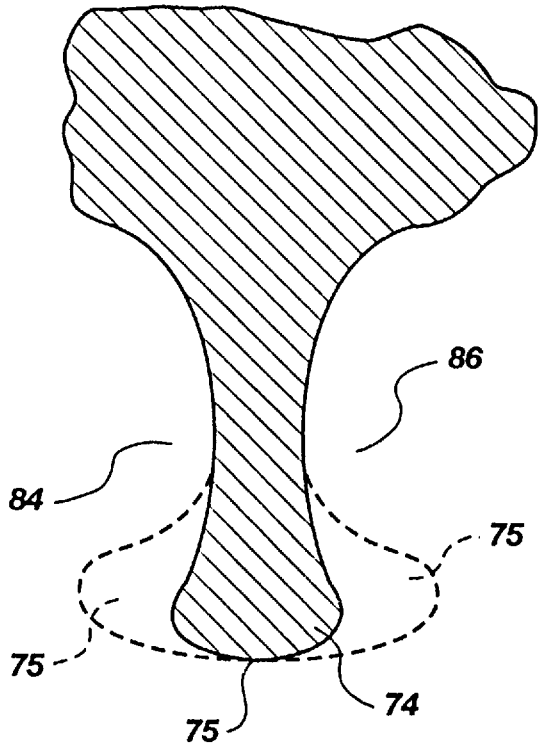
FIG. 7B is a partial cross-sectional view of a second embodiment of a portion of the drilling-related structure shown in FIG. 7A.

In another preferred embodiment illustrated in FIG. 7A, the partitions dividing the junk slots into primary and secondary flow channels comprise a plurality of fins 74 generally radially extending from the center 76 of the bit 80. As shown, the fins 74 radially extend approximately two-thirds the depth of the junk slots 82 from the bottom thereof. However, the fins 74 may be lengthened or shortened, or positioned off of a strictly radial orientation (see broken lines) and still provide recirculation of the drilling fluid. Each fin 74 divides the junk slot 82 into two channels 84 (primary) and 86 (secondary) such that drilling fluid may flow in a recirculation path through the channel 86. The fin 74 may have a flat or outwardly-tapered (convex) cross section as illustrated in FIG. 7A or an inwardly-tapered (concave) cross-section as illustrated in FIG. 7B to further assist in separating the flow between the channel 84 and the channel 86. Additionally, the outer or protruding edge 75 of fin 74 may be further enlarged beyond that shown in solid lines in FIG. 7B, and may in cross-section define a T- or L-shape as shown in broken lines. Stated another way, a combination of radial and circumferential partition segments may be employed to define primary and secondary channels.

Figure 8:
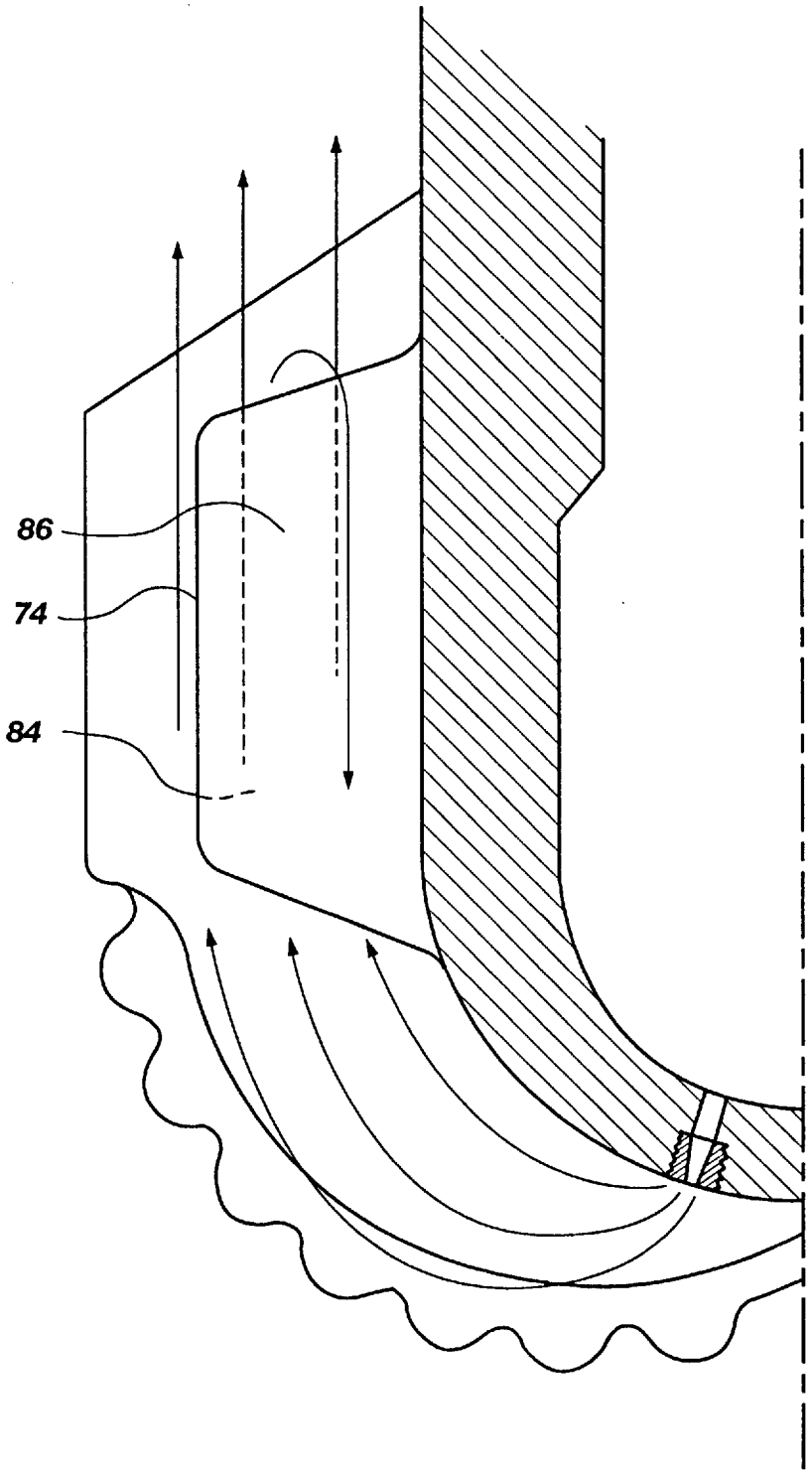
FIG. 8 is a partial cross-sectional side view of the drilling-related structure shown in FIG. 7A.

As illustrated in FIG. 8, drilling mud, represented by arrows, flows past the cutting elements and through the channel 84. Similar to the recirculation of drilling fluid provided by the wall arrangement of the previous embodiments, the fin 74 produces a similar phenomenon, although the recirculation flow path is transverse to that of FIGS. 1 through 7. Utilizing a fin 74 rather than a wall may provide for more simple manufacturing of the drill bit 80 and may be less likely to have its junk slot channels 84 and 86 become plugged or obstructed with large cuttings and debris during drilling, or when tripping into or out of the well bore.

Figure 5:
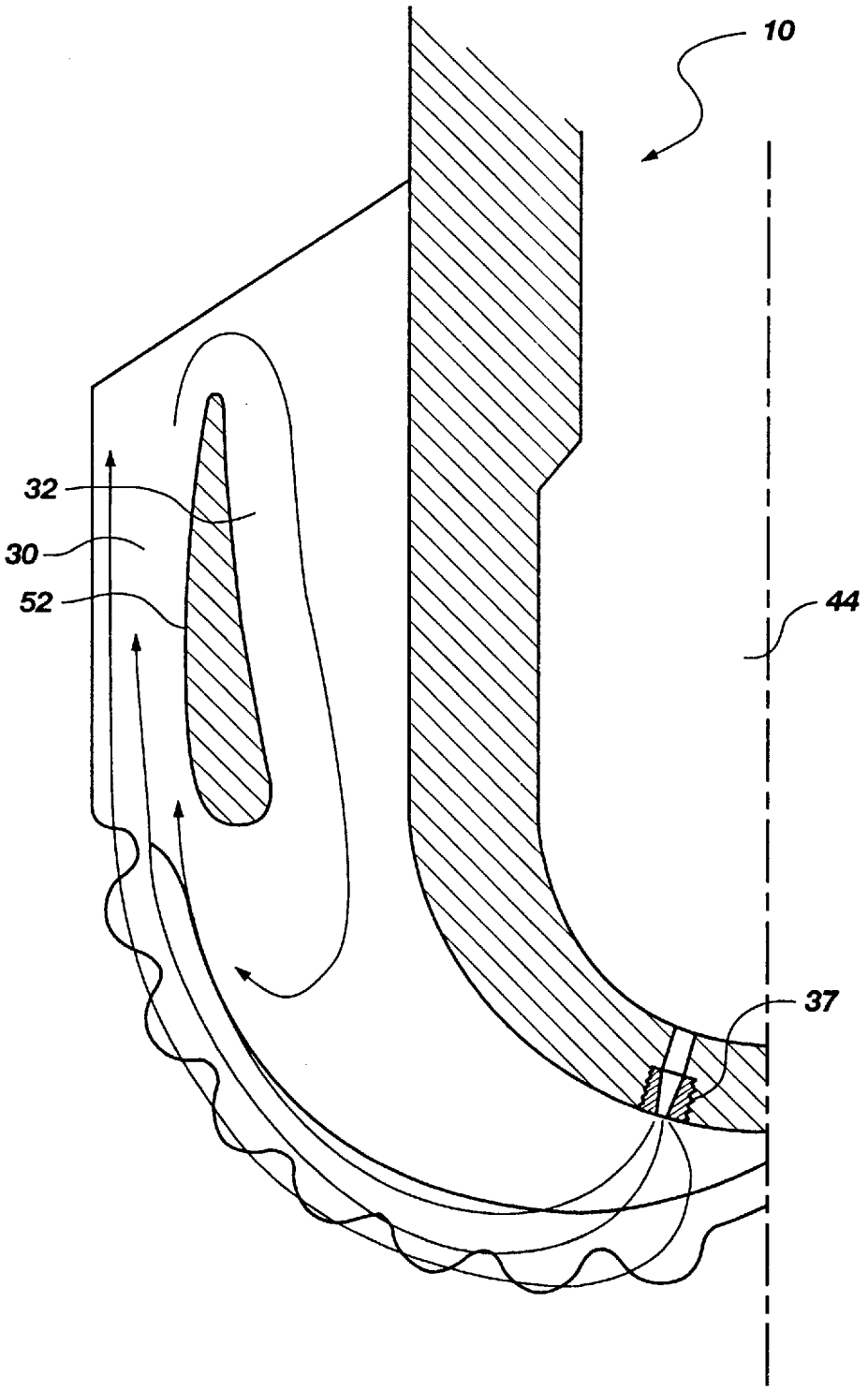
FIG. 5 is a partial cross-sectional view of the drilling-related structure shown in FIG. 1A illustrating a second embodiment of the partition.
Figure 6:
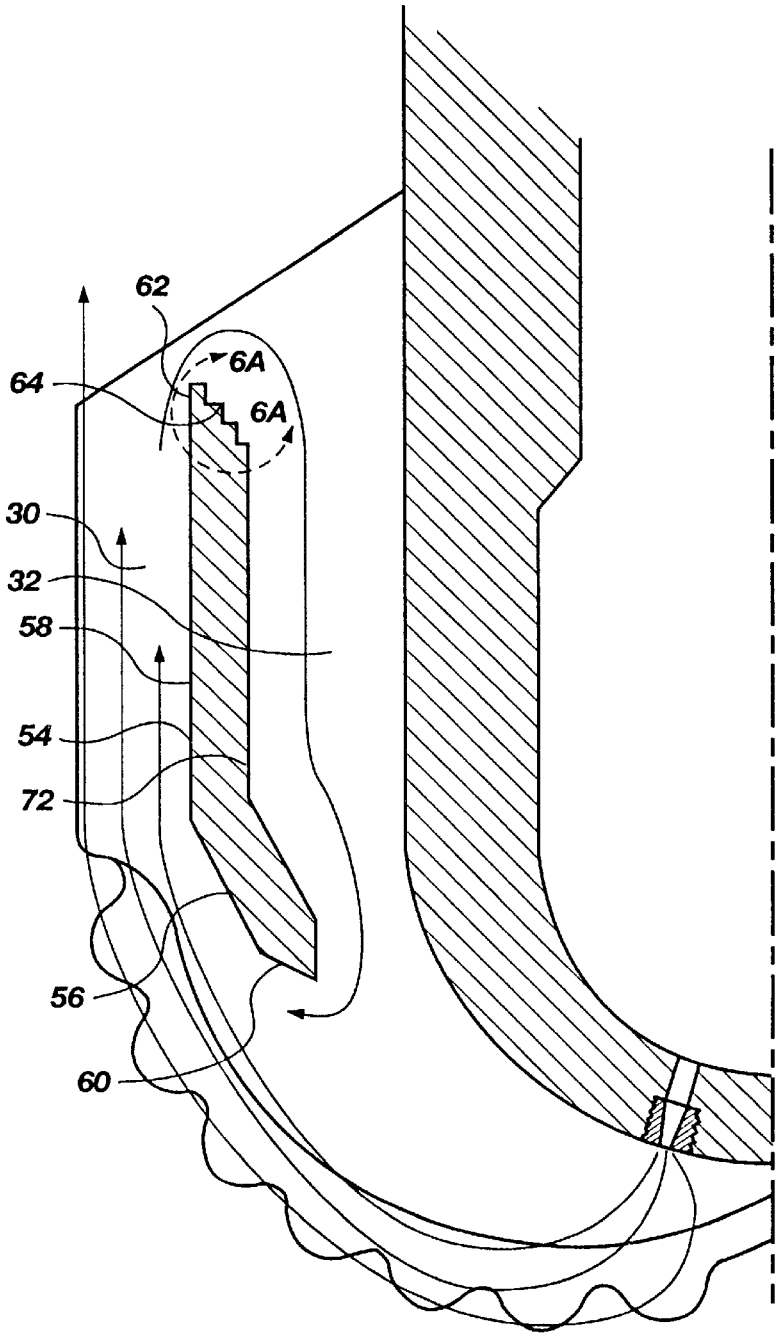
FIG. 6 is a partial cross-sectional view of the drilling-related structure shown in FIG. 1A illustrating a third embodiment of the partition and FIG. 6A is an enlargement of the structure located in area 6A—6A on FIG. 6.
Figure 6A:
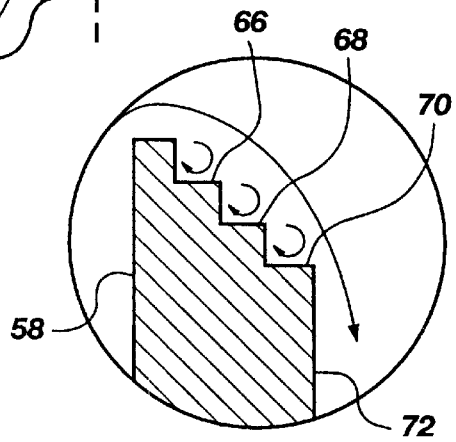

As should be recognized by those skilled in the art, many of the cross-sectional configurations illustrated and described in relation to the wall 34, such as the airfoil design of FIG. 5 and angled entry portion 56 and steps 66, 68, and 70 of FIG. 6A, may be applicable to the fin arrangement of FIGS. 7 and 8, and vice versa.

Figure 9:
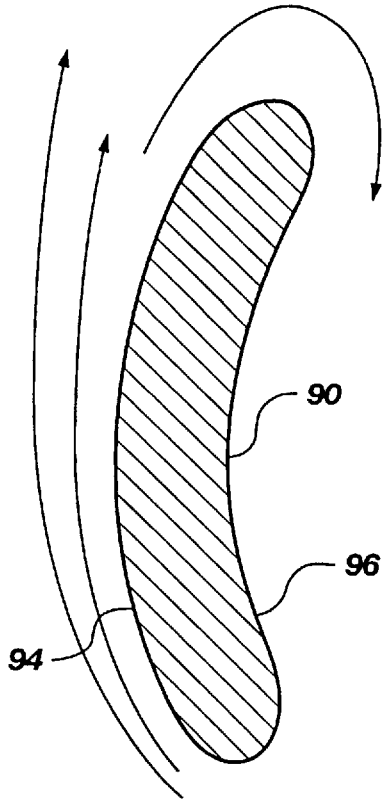
FIG. 9 is a longitudinal cross-sectional view of a fourth embodiment of the partition in accordance with the present invention.
Figure 10:
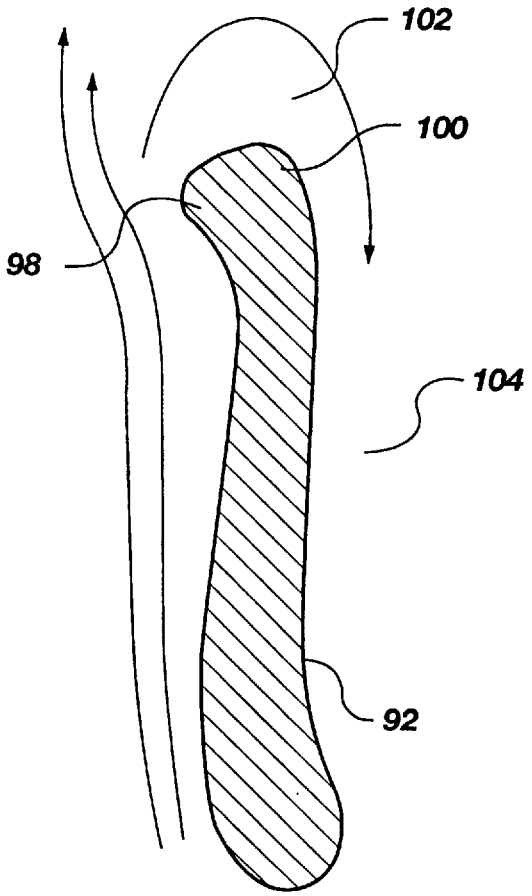
FIG. 10 is a longitudinal cross-sectional view of a fifth embodiment of the partition in accordance with the present invention.

Accordingly, the cross-sectional illustrations of the embodiments of partitions 90 and 92 shown in FIGS. 9 and 10, respectively, have equal applicability to either a wall arrangement or a fin. In FIG. 9, the partition 90 has a banana-shaped cross-section to encourage the flow of a majority of drilling fluid past the front side 94 of the partition 90 with a relatively small amount of the drilling fluid being recirculated around the back side 96. The "banana" configuration also creates a venturi effect by establishing a low pressure area on back side 96, similar to the airfoil configuration of FIG. 5. An important aspect of this invention is the ability of the partition to prevent, to a substantial extent, the recirculation of cuttings and debris generated during drilling to the cutting elements 20. Because particles of larger mass will have more inertia than smaller particles moving at the same velocity, recirculation of these larger particles may be at least partially prevented by the relatively high velocity of the drilling fluid flowing in front of the wall 34, fin 74 or partition 90 and the corresponding substantial momentum of the larger particles. The shape and configuration of the wall 34, fin 74 or partition 90 may also affect the recirculation of such particles. In FIG. 10, a deflector portion 98 may be provided proximate the top end 100 of the partition 92 to deflect larger formation particles away from the entrance 102 of the recirculation channel 104. Other, more simple configurations may be equally utilized as a flow separator such as a substantially rectangular, oval or circular partition between the channels.

Figure 11:
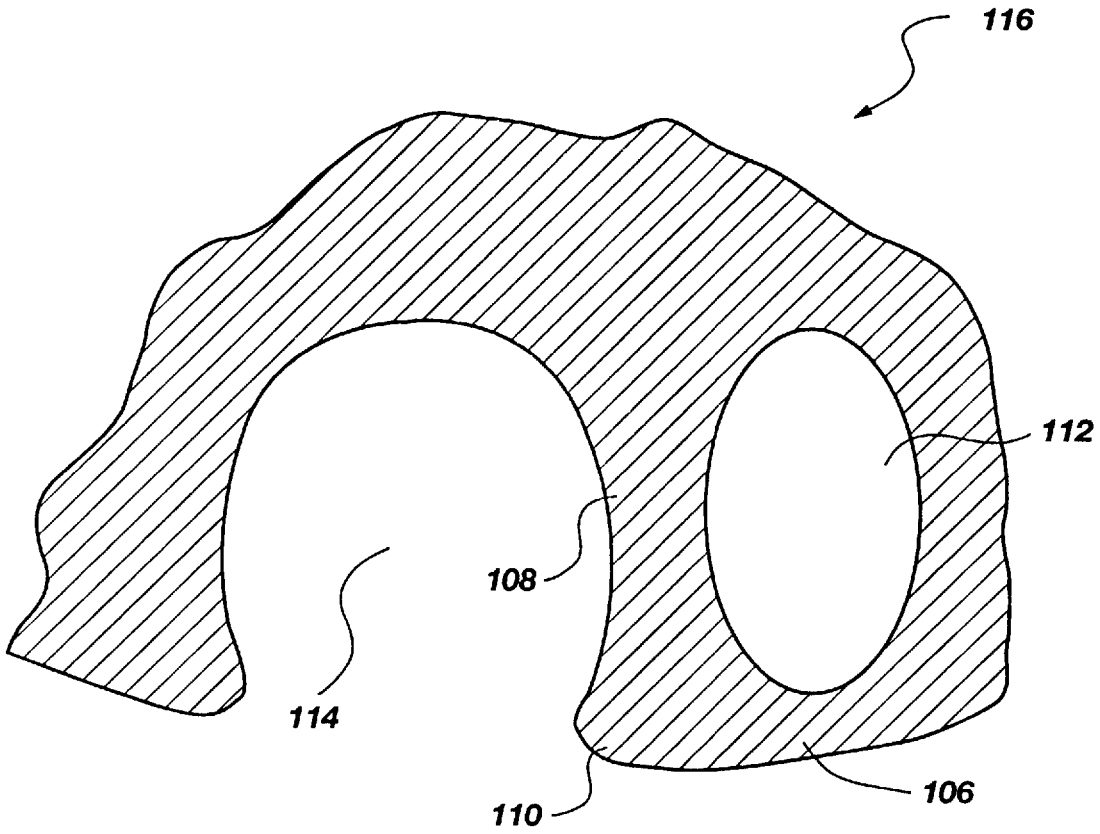
FIG. 11 is a partial cross-sectional view of a third embodiment of the drilling-related structure in accordance with the present invention.
Figure 12:
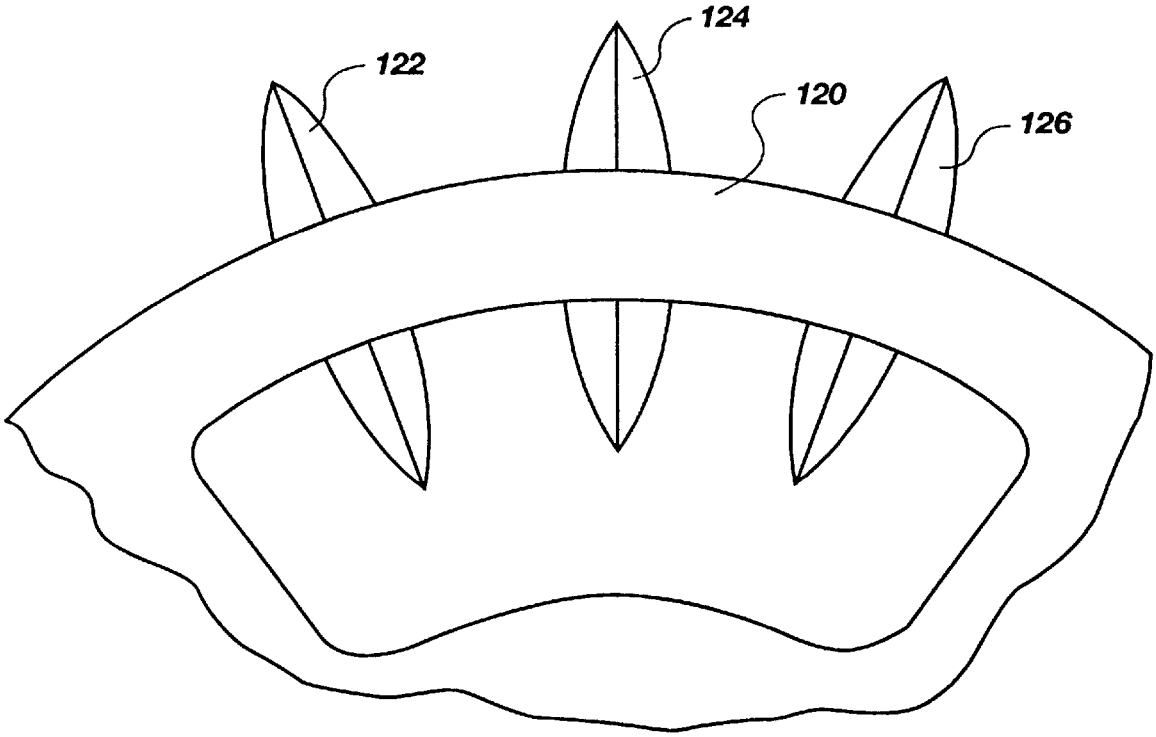
FIG. 12 is a top view of a sixth embodiment of the partition in accordance with the present invention.

In FIG. 11, a combination of a wall 106 and a fin 108 defining a partition 110 is illustrated. The partition 110 defines an enclosed recirculation channel 112 and an open trough or primary channel 114 for the positive flow of drilling mud through and from the drill bit 116. Likewise, in FIG. 12 the partition or wall 120 includes a plurality of fins or vanes 122, 124, and 126 longitudinally extending along a length of the wall 120 to define a plurality of circumferentially adjacent primary and secondary channels. By changing the number, position, and/or configuration of the vanes 122, 124, and 126, various flow patterns and recirculation loops can be created around the wall 120. It will be appreciated by those of ordinary skill in the art that recirculation channels may be defined within the bit body and communicate with any suitable area proximate the upper extent of a primary channel, as subsequently described herein.

Figure 13:
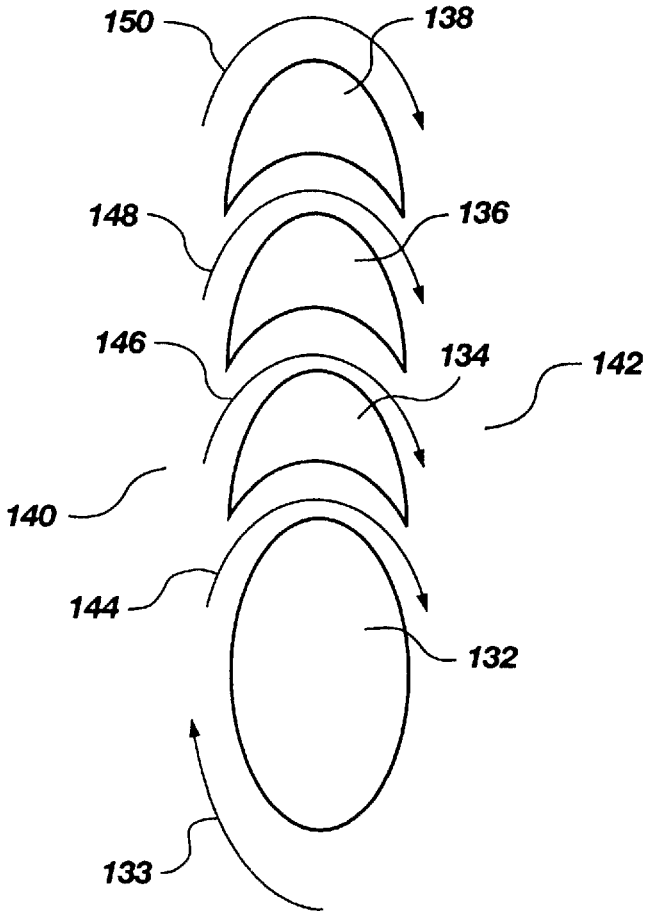
FIG. 13 is a cross-sectional view of a seventh embodiment of the partition in accordance with the present invention.

As illustrated in FIG. 13, the partition 130, whether a wall or a fin, may be comprised of a plurality of partition segments 132, 134, 136, and 138. As the flow of drilling mud (represented by arrow 133) flows through the primary channel 140, part of the flow is directed to the secondary channel 142 by the segments 134, 136, and 138. Such a configuration establishes a plurality of recirculating flow loops (represented by arrows 144, 146, 148, and 150) and may help to screen larger particles present in the primary flow 133 from entering the recirculating flow loops 144, 146, 148, and 150.

Figure 14:
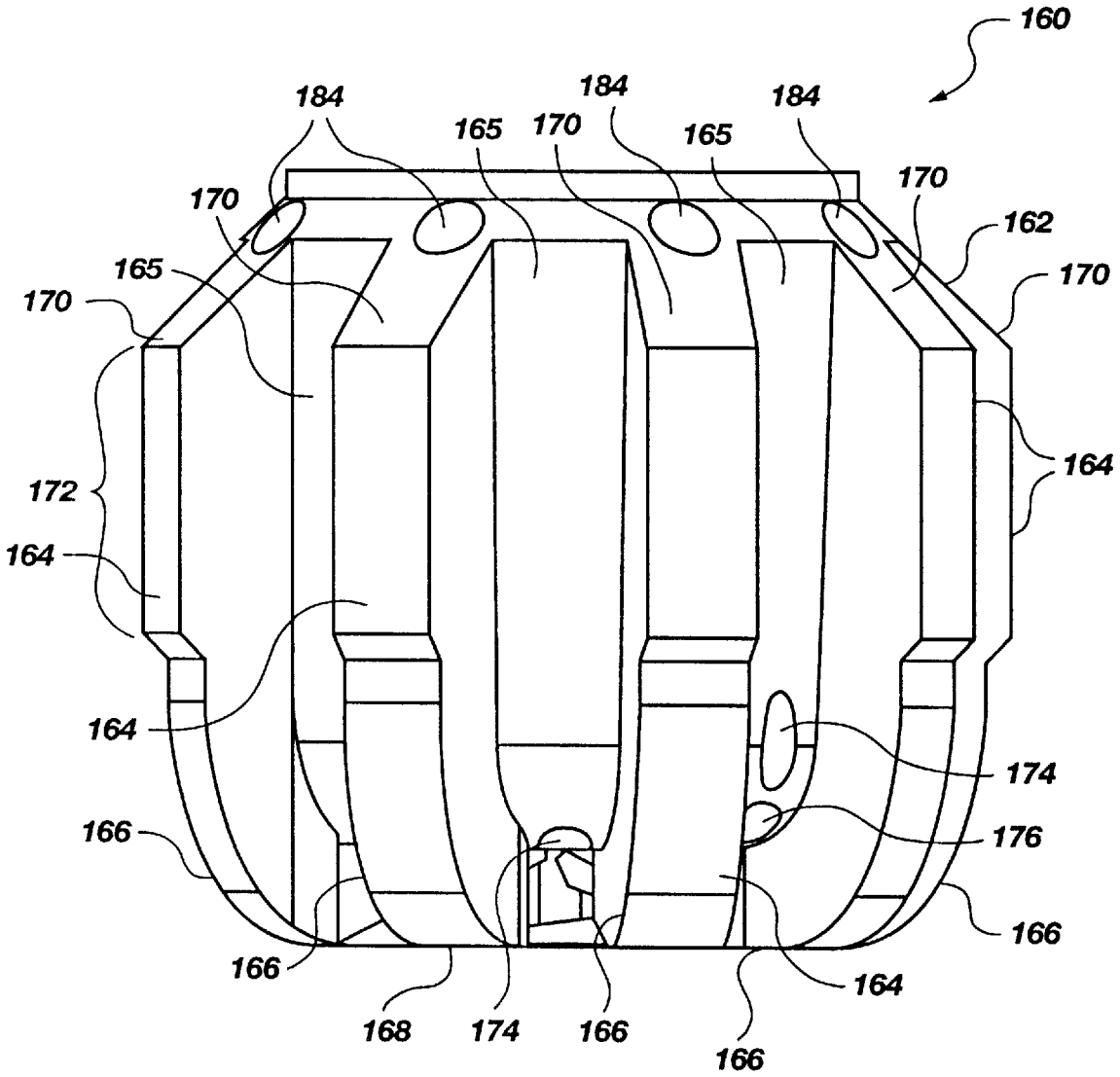
FIG. 14 is a schematic side view of a fourth embodiment of a drilling-related structure in accordance with the present invention.
Figure 15:
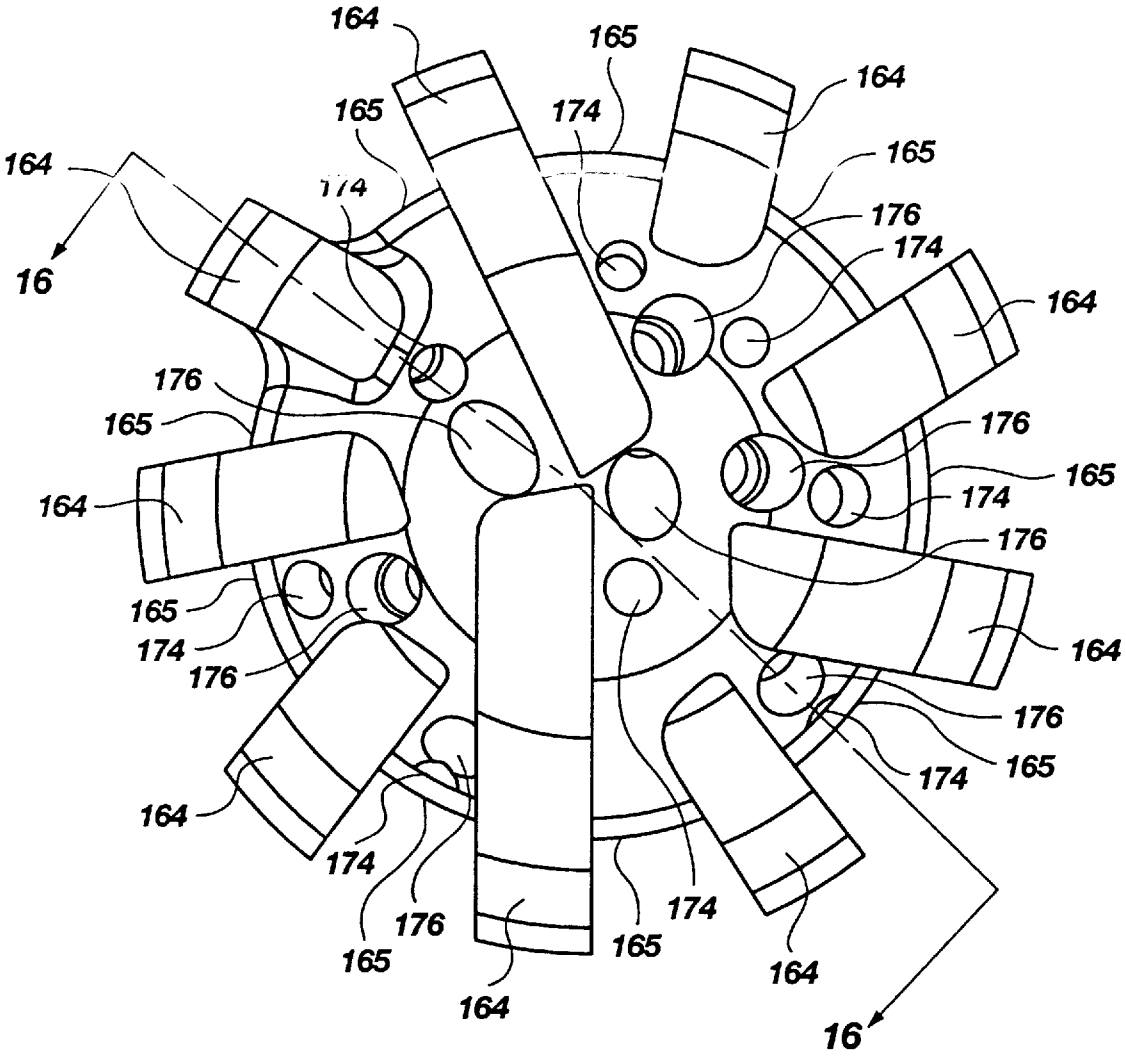
FIG. 15 is a schematic bottom view of the drilling-related structure shown in FIG. 14.
Figure 16:
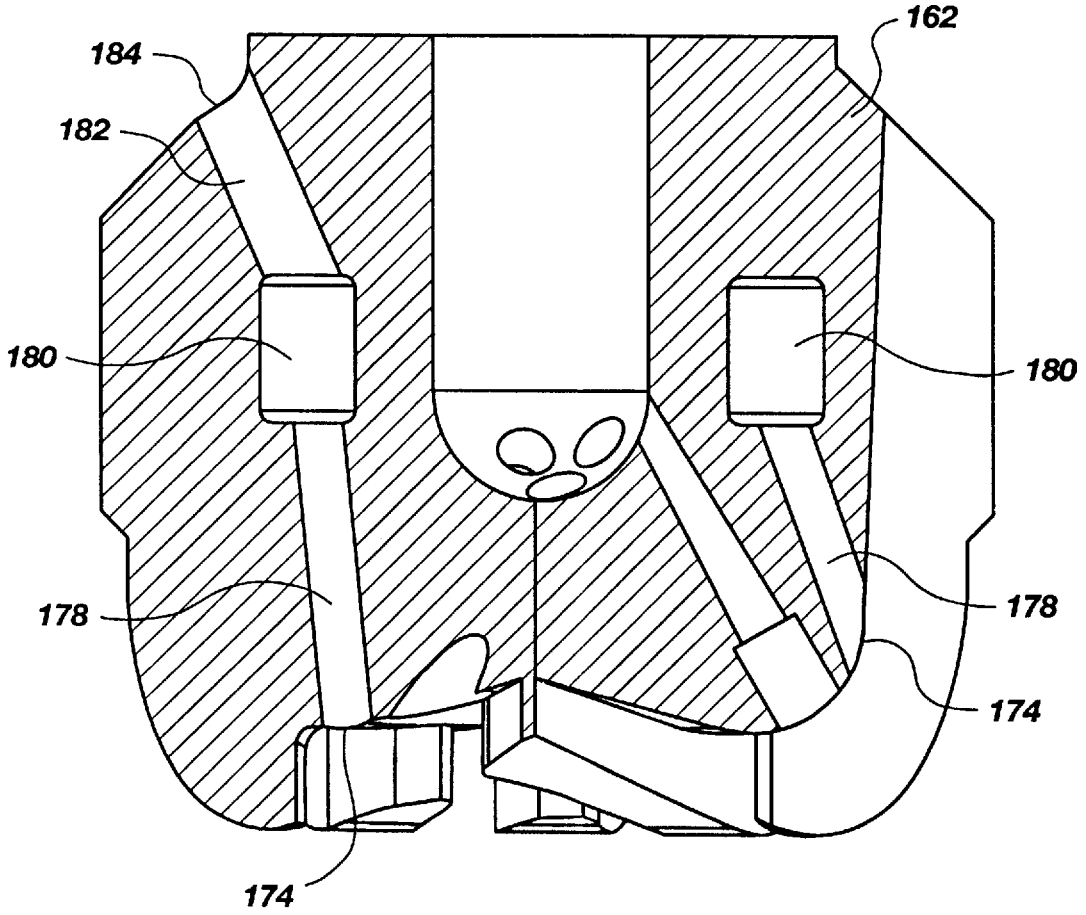
FIG. 16 is a cross-sectional view showing section 16—16 of the drilling-related structure shown in FIG. 15.

As illustrated in FIGS. 14, 15, and 16, a drill bit 160 in accordance with the present invention is comprised of a bit body 162 including a plurality of longitudinally extending body segments or blades 164 defining junk slots 165 therebetween. Each blade 164 defines a leading or cutting face 166 that extends from proximate the center of the bit face around the distal end 168 of the drill bit 160, to which a plurality of cutting elements, such as cutting elements 20 shown in FIG. 1A, may be attached to cut into a subterranean formation upon rotation of the drill bit 160. Between the uppermost extent of the cutting face 166 and the top edge 170 of the blade 164, each blade 164 defines a longitudinally and radially extending gage portion 172 that corresponds to the largest-diameter portion of the drill bit 160 and thus is only slightly smaller than the diameter of the hole to be drilled by the bit 160.

As better illustrated in FIG. 15, proximate the distal end 168 of some of the junk slots 165, one or more recirculation channel exit ports 174 may be provided, some of which are adjacent to one or more nozzle ports 176. As illustrated, the location, orientation and number of both nozzle ports 176 and recirculation channel exit ports 174 may vary from junk slot 165 to junk slot 165. Referring to FIG. 16, each recirculation channel flow channel 178 extending to the recirculation exit ports 174 is in fluid communication with an annular chamber 180 that is contained within the bit body 162. This annular chamber 180 serves at least two functions. First, it serves to equalize the pressure between all recirculation flow channels 178 communicating with the chamber 180, and second, it serves to simplify manufacturing such a bit 160 because all of the entry channels 182 of the recirculating flow extending from their respective entrance ports 184 to chamber 180 can be simply configured. Thus, complex pathways such as individual recirculation flow channels 178 extending completely from the entrance ports 184 to the exit ports 174 need not be devised nor manufactured. In addition, as illustrated, the number (eight) of flow channels 178 exiting the chamber 180 do not necessarily have to equal the number (nine) of entry channels 182. With such a configuration, areas where stagnant flow may occur, such as along the top blade edge 170, may be communicated via recirculation channels to the distal end 168 of the bit 160.

Figure 17:
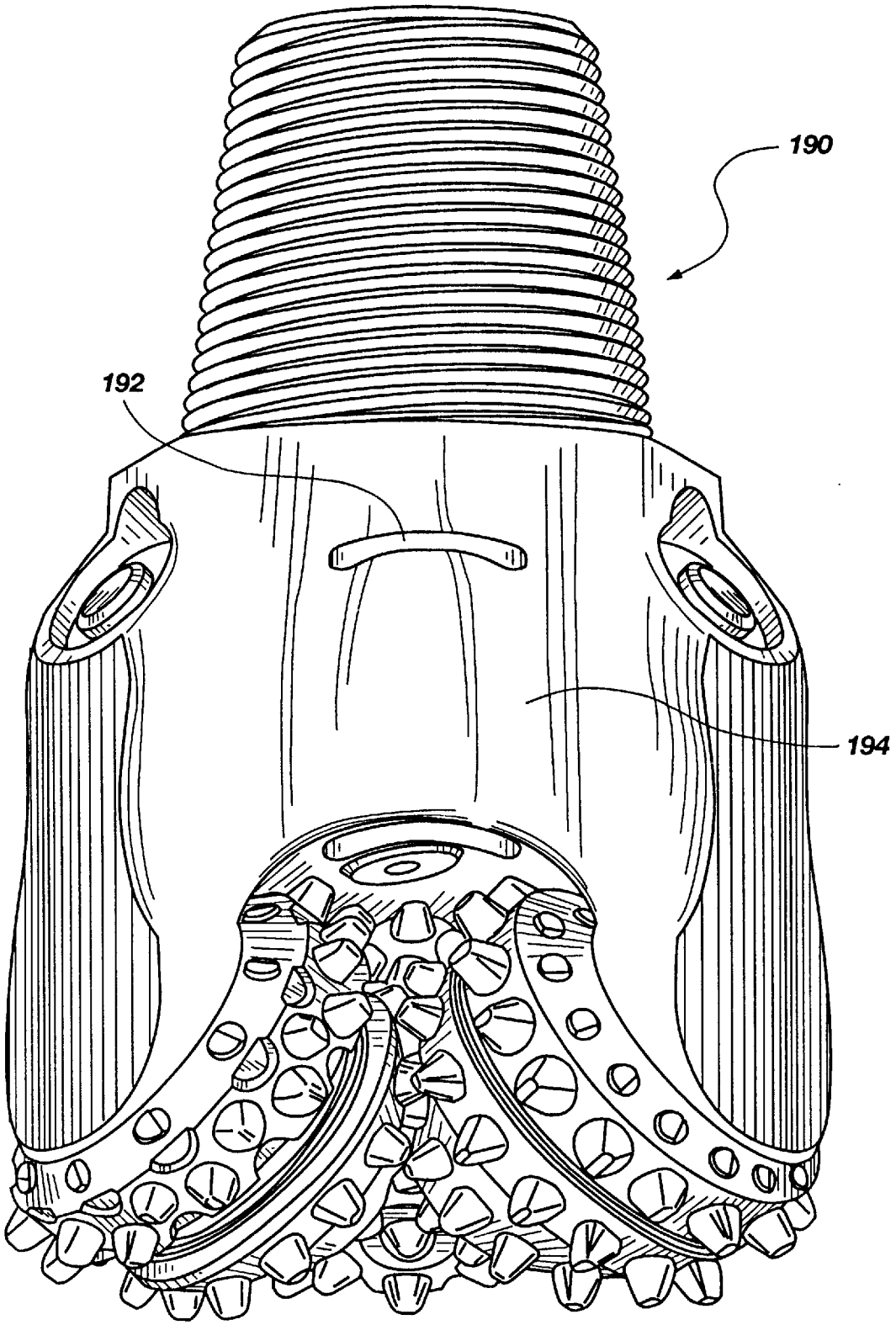
FIG. 17 is a perspective view of a fifth embodiment of a drilling-related structure in accordance with the present invention.
Figure 19:
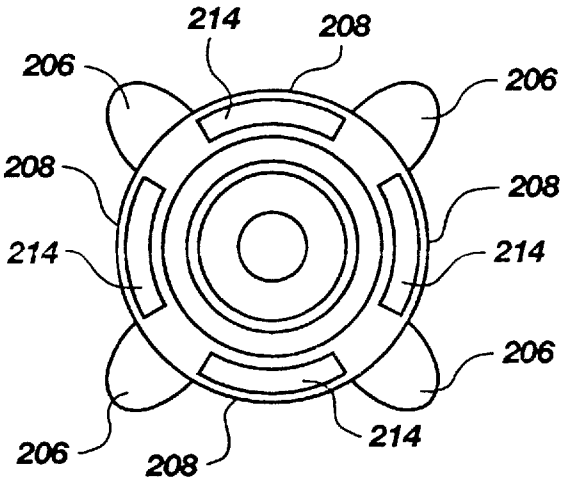
FIG. 19 is a schematic top view of the drilling-related structure shown in FIG. 18.
Figure 18:
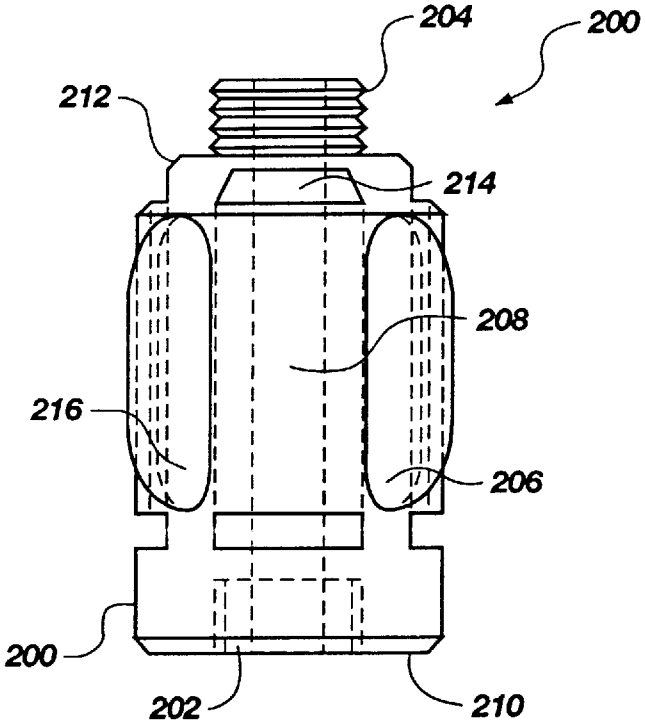
FIG. 18 is a schematic side view of a sixth embodiment of a drilling-related structure in accordance with the present invention.

Other drill bits and drilling-relating structures may also benefit from inclusion of the recirculation flow loops of the present invention. For example, as depicted in FIG. 17, a typical roller cone bit 190 may include a recirculation channel 172 in fluid communication with an associated junk slot 174. Likewise, in FIGS. 18 and 19, a near-bit stabilizer 200 may be attached to a drill bit below by an internally threaded connection 202 and to a drill string above by externally threaded connection 204. The stabilizer 200 includes blades 206 defining junk slots 208. Extending from proximate the distal end 210 of the stabilizer 200 to proximate the proximal end 212, internal recirculation channels 214 are provided such that upon the flow of drilling mud through the junk slots 208, a recirculation flow loop is established between the recirculation channel 214 and its associated junk slot 208. As with the previously-described bits, nozzles or other ports may be included in stabilizer 200 proximate the distal ends of junk slots 208 to draw fluid through recirculation channels 214. Further, structure 200 may comprise a recirculation sub without stabilizer fins or blades, as desired. As illustrated, the structure 200 affords a self-cleaning action to the blades 206.

Figure 20:
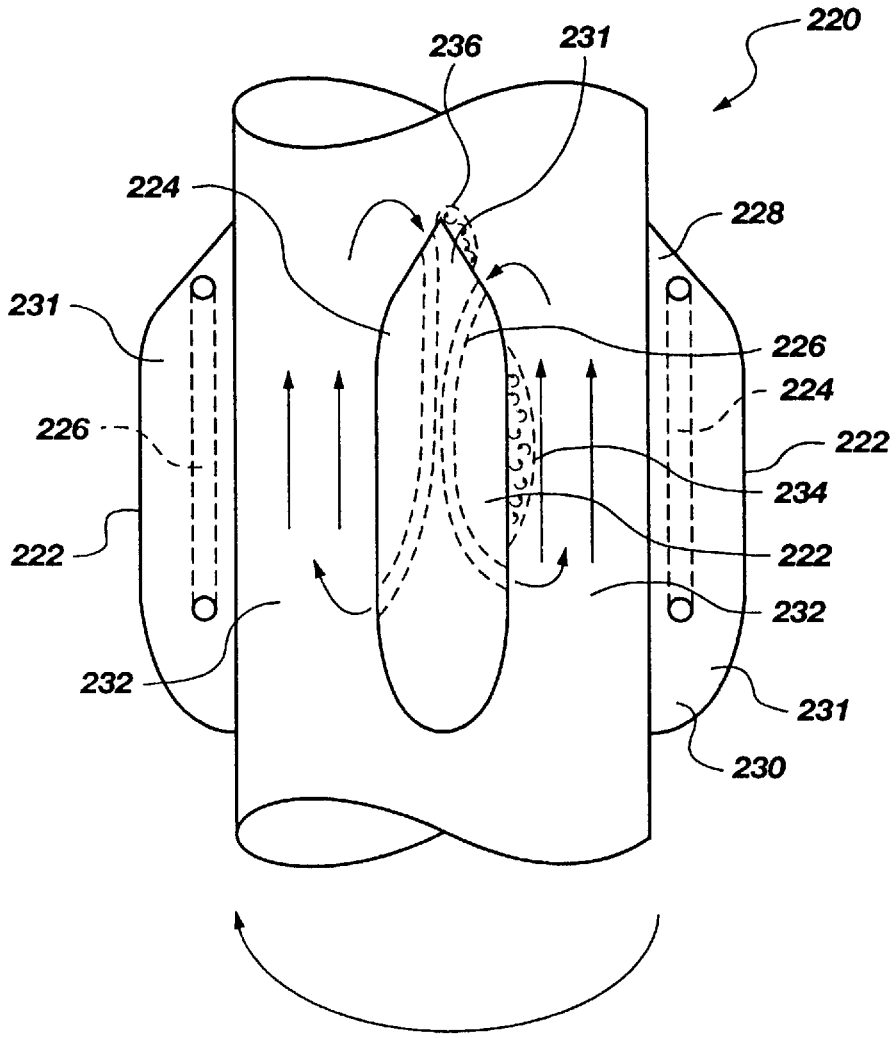
FIG. 20 is a partial schematic side view of a seventh embodiment of a drilling-related structure according to the present invention.

Similarly, in FIG. 20, a stabilizer 220 is provided with a plurality of longitudinally extending body segments or blades 222. As illustrated, each blade 222 may be provided with one or more recirculation channels 224 and 226 such that recirculation may be provided from proximate a top end 228 of the blade 222 to proximate a bottom end 230, or even to a stagnant flow area such as 234 on the lee side of a blade or from area 236 at the top of a blade. It should be noted that, similar to the blades 14 of the bit 10, streamlining of the exterior surfaces 231 of the blades 222 of the stabilizer 220 has equal importance to help maintain positive flow through all of the stabilizer's associated junk slots 232 and prevent stagnant flow zones.

Figure 21:
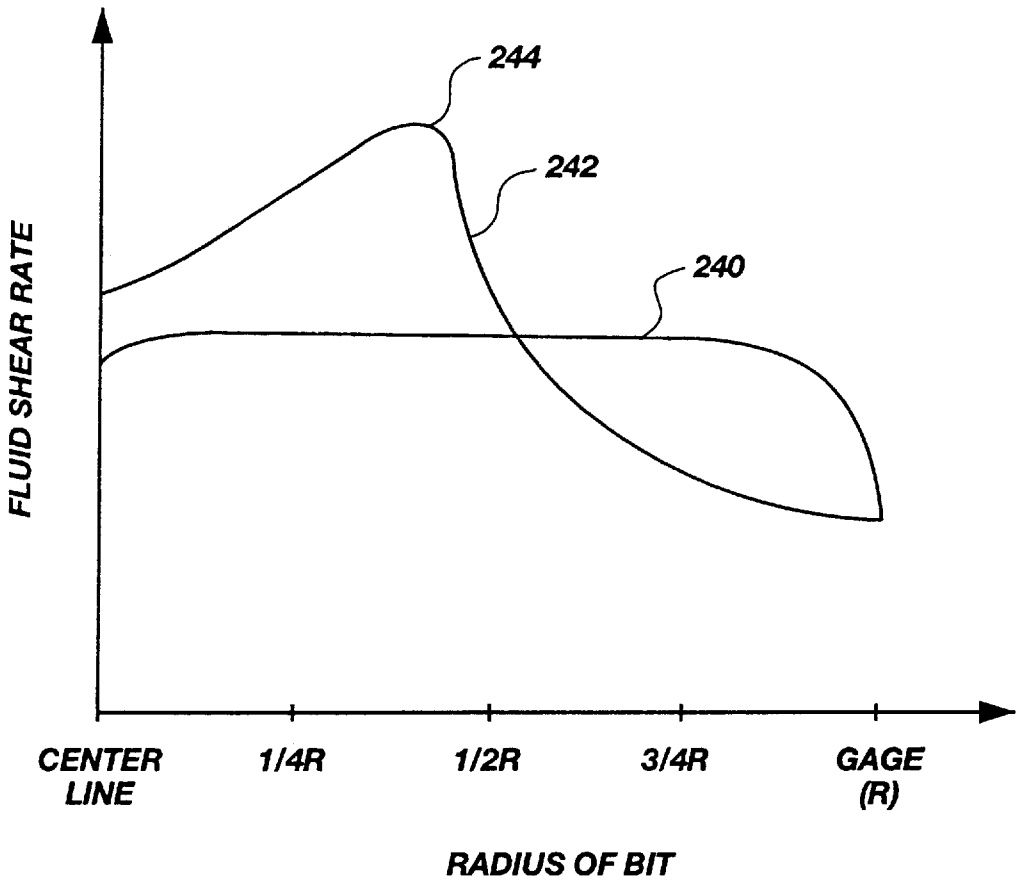
FIG. 21 is a graphical representation of the shear rate of a prior art drill bit compared to a drill bit in accordance with the present invention.

In addition to maintaining positive flow of drilling mud through the junk slots and water course ways of the drilling structures of the present invention, recirculation of the drilling mud, especially in the context of drill bits, may have added benefits. For example, as illustrated in FIG. 21, two superimposed curves show the difference in shear rate versus radius between a drill bit employing recirculation according to the present invention (line 240) and a similarly-configured prior art bit (line 242). Shear rate, which is defined relative to a surface past which fluid is moving in contact therewith (in this instance, for example, the bit face or cutting structure) is the velocity gradient expressed as velocity divided by perpendicular distance from the reference surface over a relatively small distance range (e.g., the velocity gradient for fluid in proximity to the bit). For a given fluid, a higher shear rate is indicative of a higher fluid velocity at a given distance in close proximity to a reference surface. Shear stress and shear rate are directly proportional for Newtonian fluids. While most drilling fluids are non-Newtonian, the shear rate value is still believed to provide a valuable indicator for bit hydraulics analysis. As shown with regard to a prior art bit, the shear rate curve 242 may include a significant and sharply-defined peak generated by the flow of drilling fluid. Such a peak may result in less efficient drilling by the drill bit, as high shear energy is concentrated near the bit axis, followed by rapid reduction of same toward and at the bit gage. Further, the unduly high fluid energy near the bit axis may precipitate erosion of the bit face and blades in that region, while fluid traversing cutters farther from the bit axis may lack sufficient energy for adequate cooling and cuttings removal and transport from the bit. In comparison, a drill bit including one or more recirculation flow loops according to the invention maintains a shear rate without a notable peak, and preferably of a substantially constant value or relatively uniform distribution along the radius of the bit from near the axis to proximate the gage, as shown by line 240. Thus, a drill bit configured according to the present invention will have less tendency to erode proximate the center region of the bit face. Further, cooling of the cutters as well as cuttings removal for all cutters on the bit face area served by a recirculation loop will be enhanced and cuttings transport from the bit improved, thus increasing drilling efficiency.

In the exemplary embodiments, the present invention has been illustrated according to several drilling-related structures. Those skilled in the art, however, will appreciate that there may be other bits and drilling-related structures, such as percussion or impact bits, vibration bits, coring bits, and in-line drill string tools in addition to those referenced above where this invention may have applicability. Moreover, the size, shape, and/or configuration thereof may vary according to design parameters without departing from the spirit of the present invention. Further, the invention may be practiced on non-bladed drill bits, the term "blade" as used herein intended as exemplary and not limiting, the invention having applicability to any drilling-related structure employing a junk slot or other channel for passage of fluid therethrough defined by radially-extending body segments. As noted, recirculation channels may be internal to the bit, as may the primary channels or internal "junk slots" in bits according to U.S. Pat. No. 5,199,511 to Tibbitts, assigned to the assignee of the present invention. Moreover, although this invention has been described with respect to steel and matrix-type bits, those skilled in the art will appreciate this invention's applicability to drill bits manufactured from other suitable materials and by processes other than those disclosed herein, including layered manufacturing processes such as are disclosed in U.S. Pat. No. 5,433,280 to Smith and assigned to the assignee of the present invention. It will also be appreciated by one of ordinary skill in the art that one or more features of any of the illustrated embodiments may be combined with one or more features from another to form yet another combination within the scope of the invention as described and claimed herein. Thus, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A method of stabilizing drilling fluid flow within channels of a drilling structure, comprising:

establishing upward fluid flow in at least one substantially longitudinally extending channel of said drilling structure; and recirculating at least a portion of said upward fluid flow from said at least one channel through an associated recirculation channel at least partially physically partitioned therefrom.

2. The method of claim 1, further including promoting said upward fluid flow with a fluid jet.

3. The method of claim 2, further including entraining fluid flow from said recirculating portion of said upward fluid flow with said fluid jet.

4. The method of claim 1, further comprising structuring a venturi arrangement on said drilling structure proximate a location wherein said recirculation channel communicates with said at least one channel.

5. The method of claim 1, further comprising transferring momentum of said upward fluid flow to fluid within said recirculation channel to effect said recirculation.

6. The method of claim 1, further comprising structuring an eductor arrangement on said drilling structure proximate a location wherein said recirculation channel communicates with said at least one channel.

7. The method of claim 1, further comprising establishing upward flow of drilling fluid in a plurality of circumferentially disposed, substantially longitudinally extending channels of said drilling structure, and recirculating a portion of said upward flow from each of said plurality of channels through an associated recirculation channel.

8. The method of claim 7, further comprising backfilling fluid to each of said plurality of channels from an associated recirculation channel to prevent fluid thiefage between adjacent ones of said plurality of channels.

9. The method of claim 7, wherein said upward flow in each of said plurality of channels is substantially isolated from other channels of said plurality of channels.

10. The method of claim 1, further comprising providing a cutting structure on said drilling structure extending between a longitudinal centerline thereof to a radial periphery thereof, and flowing said drilling fluid past said cutting structure along said at least one channel from a location proximate said centerline to a location proximate said periphery with a generally constant shear rate.

11. The method of claim 1, further comprising providing a cutting structure on said drilling structure extending between a longitudinal centerline thereof to a radial periphery thereof, and flowing said drilling fluid past said cutting structure along said at least one channel from a location proximate said centerline to a location proximate said periphery without a clearly-defined peak in shear rate.

12. The method of claim 1, further comprising extending said associated recirculation channel to an area of otherwise stagnant flow on an exterior of said drilling structure.

* * * * *

UNITED STATES PATENT AND TRADEMARK OFFICE

CERTIFICATE OF CORRECTION

PATENT NO. : 5,836,404
DATED : November 17, 1998
INVENTOR(S) : Trujillo et al.

It is certified that error appears in the above-identified patent and that said Letters Patent is hereby corrected as shown below:

Title page,
Item [56], References Cited, OTHER PUBLICATION, change "Modleing" to -- Modelling --.

Column 5,
Line 52, after "fin" and before the comma, delete the space.

Column 7,
Line 42, after "6A-6A" delete "on FIG. 6".

Column 9,
Line 4, change "center 35 line" to -- center line 35 --.

Column 10,
Line 58, change "partition" to -- wall --.

Column 11,
Line 26, "therebetween" is improperly hyphenated.
Lines 53-54, change "recirculating" to -- recirculation --.

Column 12,
Line 2, change "172" to -- 192 --.
Line 3, change "174" to -- 194 --.

Column 14,
Line 37, after "flowing" delete -- said --.
Line 40, before "periphery" insert -- radial --.
Line 42, delete "a".
Line 44, after "flowing" delete -- said --.
Line 47, before "periphery" insert -- radial --.

Signed and Sealed this

Thirteenth Day of August, 2002

*Attest:*

*Attesting Officer*

JAMES E. ROGAN
*Director of the United States Patent and Trademark Office*